US009316935B2

(12) United States Patent
Iwazaki et al.

(10) Patent No.: US 9,316,935 B2
(45) Date of Patent: Apr. 19, 2016

(54) TONER FOR ELECTROSTATIC LATENT IMAGE DEVELOPMENT, ELECTROSTATIC LATENT IMAGE DEVELOPER, TONER CARTRIDGE, PROCESS CARTRIDGE, AND IMAGE FORMING APPARATUS

(75) Inventors: Eisuke Iwazaki, Kanagawa (JP); Satoshi Yoshida, Kanagawa (JP); Shintaro Anno, Kanagawa (JP); Masaki Nakamura, Kanagawa (JP); Satoshi Inoue, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 407 days.

(21) Appl. No.: 12/852,870

(22) Filed: Aug. 9, 2010

(65) Prior Publication Data

US 2011/0189604 A1 Aug. 4, 2011

(30) Foreign Application Priority Data

Feb. 1, 2010 (JP) ..... 2010-020556

(51) Int. Cl.

| | |
|---|---|
| ***G03G 9/087*** | (2006.01) |
| ***G03G 9/00*** | (2006.01) |
| ***G03G 15/08*** | (2006.01) |
| ***G03G 21/16*** | (2006.01) |

(52) U.S. Cl.

CPC ..... *G03G 9/00* (2013.01); *G03G 15/08* (2013.01); *G03G 21/16* (2013.01)

(58) Field of Classification Search

USPC ..... 430/108.23, 108.6, 108.7, 108.8; 399/222

See application file for complete search history.

(56) References Cited

U.S. PATENT DOCUMENTS

| | | | | |
|---|---|---|---|---|
| 4,654,411 | A | 3/1987 | Serini et al. | |
| 5,478,686 | A * | 12/1995 | Kawakami et al. | 430/109.4 |
| 6,030,737 | A * | 2/2000 | Ugai et al. | 430/108.23 |
| 2003/0152859 | A1 | 8/2003 | Emoto et al. | |
| 2003/0190544 | A1 * | 10/2003 | Tanaka et al. | 430/108.23 |
| 2004/0137352 | A1 * | 7/2004 | Mc Stravick et al. | 430/108.11 |
| 2004/0228648 | A1 * | 11/2004 | Yanagida et al. | 399/100 |
| 2005/0117919 | A1 * | 6/2005 | Ito et al. | 399/27 |
| 2005/0164108 | A1 | 7/2005 | Murakami et al. | |
| 2007/0238040 | A1 * | 10/2007 | Veregin et al. | 430/107.1 |
| 2007/0269732 | A1 * | 11/2007 | Matsumura et al. | 430/114 |
| 2008/0118855 | A1 | 5/2008 | Nakayama et al. | |
| 2009/0011356 | A1 * | 1/2009 | Tomita et al. | 430/109.4 |

(Continued)

FOREIGN PATENT DOCUMENTS

| | | |
|---|---|---|
| CN | 101299141 A | 11/2008 |
| JP | A-61-073729 | 4/1986 |

(Continued)

OTHER PUBLICATIONS

Translation of JP 2004-170606 published Jun. 2004.*

(Continued)

*Primary Examiner* — Peter Vajda
(74) *Attorney, Agent, or Firm* — Oliff PLC

(57) ABSTRACT

A toner for electrostatic latent image development is disclosed. The toner for electrostatic latent image development includes toner particles, the toner particles includes a binder resin and a release agent, and the toner has a linear thermal expansion coefficient in accordance with JIS K 7197-1991 of from about $6\times10^{-5}$/C.° to about $1\times10^{-3}$/C.°. An electrostatic latent image developer, a toner cartridge, a process cartridge, and an image forming apparatus are also disclosed.

16 Claims, 3 Drawing Sheets

(56) References Cited

U.S. PATENT DOCUMENTS

| | | | | |
|---|---|---|---|---|
| 2009/0167571 | A1 | 7/2009 | Loo | |
| 2009/0274972 | A1* | 11/2009 | Sato et al. | 430/108.2 |

FOREIGN PATENT DOCUMENTS

| | | | | |
|---|---|---|---|---|
| JP | A-7-199524 | | 8/1995 | |
| JP | A-2003-162092 | | 6/2003 | |
| JP | 2004-170606 | * | 6/2004 | G03G 21/00 |
| JP | A-2004-170606 | | 6/2004 | |
| JP | A-2005-171107 | | 6/2005 | |
| JP | A-2005-173570 | | 6/2005 | |
| JP | A-2006-113313 | | 4/2006 | |
| JP | A-2008-129308 | | 6/2008 | |
| JP | A-2008-129416 | | 6/2008 | |
| JP | A-2009-156917 | | 7/2009 | |

OTHER PUBLICATIONS

Australian Office Action issued in Australian Patent Application No. 2010219414 dated Jun. 9, 2011.

Feb. 21, 2013 Office Action issued in Chinese Patent Application No. 201010288305.9 (with English translation).

Sep. 25, 2013 Information Submission issued in Japanese Patent Application No. 2010-20556 (with translation).

Nov. 12, 2013 Notice of Reasons for Rejection issued in Japanese Patent Application No. 2010-020556 (with translation).

* cited by examiner

TONER FOR ELECTROSTATIC LATENT IMAGE DEVELOPMENT, ELECTROSTATIC LATENT IMAGE DEVELOPER, TONER CARTRIDGE, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2010-020556 filed on Feb. 1, 2010.

BACKGROUND

1. Technical Field

The present invention relates to a toner for electrostatic latent image development, an electrostatic latent image developer, a toner cartridge, a process cartridge, and an image forming apparatus.

2. Related Art

Like electrophotography, a method of visualizing image information through processes of forming an electrostatic latent image and developing the electrostatic latent image has been used in a variety of fields. In this method, an image is formed by charging the overall surface of a photoreceptor, exposing the surface of the photoreceptor to a laser beam corresponding to the image information for forming an electrostatic latent image, developing the electrostatic latent image with a developer including a toner to form a toner image, and transferring and fixing the toner image to the surface of a recording medium.

The toner used in electrophotography is typically produced by a kneading and pulverizing method of melting, kneading, and cooling a plastic resin together with a pigment, a charge-controlling agent, a release agent, and a release agent of a magnetic material, then pulverizing the resultant, and classifying the resultant.

SUMMARY

According to an aspect of the invention, a toner for electrostatic latent image development including toner particles, the toner particles including a binder resin and a release agent, and the toner having a linear thermal expansion coefficient in accordance with JIS K 7197-1991 of from about $6\times10^{-5}$/° C. to about $1\times10^{-3}$/° C., is provided.

BRIEF DESCRIPTION OF THE DRAWINGS

Exemplary embodiments of the invention will be described in detail based on the following figures, wherein.

DETAILED DESCRIPTION

Figure 1:
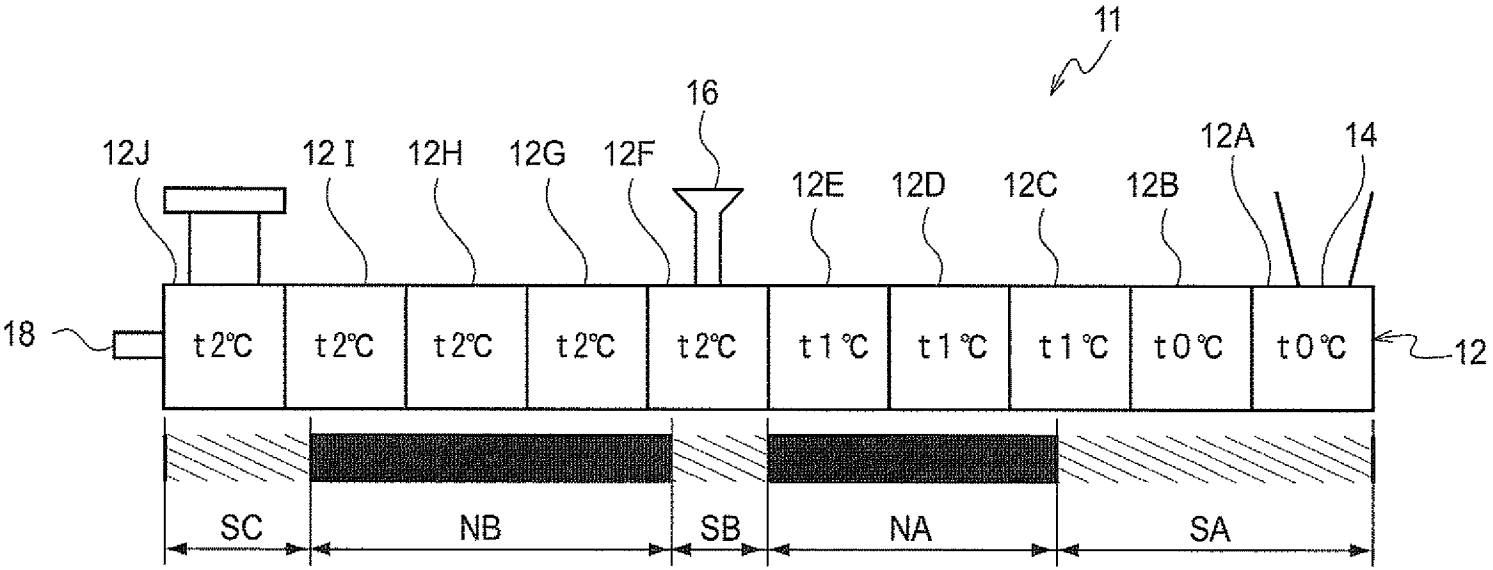
FIG. 1 is a diagram illustrating a state of a screw in an example of a screw extruder used to produce a toner for electrostatic latent image development according to an exemplary embodiment of the invention.

Hereinbelow, exemplary embodiments of a toner for electrostatic latent image development, an electrostatic latent image developer, a toner cartridge, a process cartridge, and an image forming apparatus are described in detail.

Toner for Electrostatic Latent Image Development

The toner for electrostatic latent image development (hereinafter sometimes simply referred to as a "toner") according to the exemplary embodiment includes toner particles including a binder resin and a release agent, and has a linear thermal expansion coefficient in accordance with JIS K 7197-1991 of from $6\times10^{-5}$/° C. (or about $6\times10^{-5}$/° C.) to $1\times10^{-3}$/° C. (or about $1\times10^{-3}$/° C.). The disclosure of JIS K 7197-1991 is incorporated with reference herein.

In general, the surface temperature of a fixing member (for example, a fixing roller) is lower than a set temperature, because the surface of the fixing member loses the heat to a recording medium (for example, a recording sheet, hereinafter simply referred to as "sheet") while the sheet is passing through an image forming apparatus. Particularly, in an image forming apparatus of low energy consumption or of reduced size, it tends to be difficult for the fixing member to hold the heat.

When the surface temperature of the fixing member becomes lower than the set temperature, the fixing member is heated by a heating member. The surface temperature of the fixing member rapidly becomes close to the set temperature due to the heating, and the heating is ended when the surface temperature of the fixing member reaches the set temperature. However, the surface temperature of the fixing member may sometimes rise continuously even after the heating is ended, and, as a result, the surface temperature of the fixing member may become higher than the set temperature.

When the sheet passes through the image forming apparatus and an image is printed out in the state where the surface temperature of the fixing member is higher than the set temperature, halftone dots of the fixed image may be degraded, and the halftone dot reproducibility of the fixed image may be deteriorated. Particularly, this phenomenon may be remarkable in a halftone dot image of an image fixed onto a portion closer to the end of a sheet in the traveling direction (hereinafter, "the end of a sheet in the traveling direction" may be simply referred to as "the end of a sheet"). The reason is thought to be as follows.

A binder resin contained in a toner may easily become elastic in a fixing temperature area. By heating and pressing, the toner permeates through the fibers of the sheet, thereby expressing the fixing property. On the other hand, when the surface temperature of the fixing member is higher than the set temperature, the surface of the fixing member may have a large amount of heat. For this reason, when the sheet having the toner attached thereto comes in contact with such a fixing member, the elasticity of the binder resin may be lowered and, therefore, the toner may more easily permeate into the sheet.

When both of heating and pressing are carried out, the binder resin may tend to easily spread from a high-pressure position to a low-pressure position as the toner permeates into the sheet. As a result, the halftone dots in the end of the sheet may be enlarged, whereby a degraded image may be easily obtained. Particularly, when a fixing roller is used as the fixing member, since the sheet is wound on the fixing roller and then detached therefrom, the end portion of the sheet is heated for a longer time, and, thus the toner can more easily permeate into the sheet. As a result, the halftone dots in the end portion of the sheet may be degraded, thereby making it difficult to suppress the deterioration in halftone dot reproducibility of the fixed image.

The halftone dot reproducibility in the end portion of the sheet tends to decrease as the number of printed sheets increases. It is thought that this is because foreign matter can be easily attached to the fixing member as the number of printed sheets increases, the detachability from the sheet is lowered due to the foreign matter, and halftone dots may become easily enlarged due to the pressing for the fixing.

In the toner according to the exemplary embodiment, it is thought that, by controlling a linear thermal expansion coefficient of the toner, the melting of the toner that has come in contact with the fixing member may be suppressed and, thus, the toner may be less likely to flow to a low-pressure portion of the sheet even when the surface of the fixing member is overheated and the fixing temperature is higher than the set temperature (for example, higher than the set temperature and equal to or less than a temperature of ±10° C. of the temperature range of from 140° C. to 180° C.). It is also thought that, as a result, the appropriate permeation of the toner into the sheet may be maintained, thereby suppressing the deterioration in halftone dot reproducibility of the fixed image without deteriorating the halftone dot reproducibility due to the enlargement of the halftone dots.

In the toner according to the exemplary embodiment, by controlling the linear thermal expansion coefficient of the toner, it is possible to suppress the deterioration in halftone dot reproducibility of the fixed image in the state where the fixing temperature is higher than the set temperature, but it is preferable that the halftone dot reproducibility of the fixed image is not deteriorated at the time of fixing in the state where the surface temperature of the fixing member is not overheated and is equal to the set temperature.

For this purpose, the toner preferably has the following structure.

The binder resin is not particularly limited, but preferable examples thereof include ethylene resins such as polyethylene or polypropylene, styrene resins containing polystyrene or poly(α-methylstyrene) as a major component, (meth)acryl resins containing polymethyl (meth)acrylate or poly(meth) acrylonitrile as a major component, polyamide resins, polycarbonate resins, polyether resins, polyester resins, and copolymer resins thereof. These examples may be used as the binder resin singly or in combination of two or more. The polyester resins are more preferably used in view of the sharp melt property, and the compatibility of the halftone dot reproducibility and the uneven gloss suppression.

The release agent is not particularly limited, and polypropylene, polyethylene, or paraffin can be preferably used. Particularly, paraffin wax is more preferable in view of the sharp melt property, the detachability, and the uneven gloss suppression.

The shape factor (SF1) of toner particles is preferably in the range of from 145 (or about 145) to 170 (or about 170). When the shape factor (SF1) of the toner particles is in the above-mentioned range, it is possible to further suppress the deterioration in halftone dot reproducibility of the fixed image, compared with the case where the shape factor is not in the range of from 145 to 170.

It is preferable that a material having an effect of decreasing viscosity in a low-temperature area, a material having an effect of increasing viscosity in a high-temperature area and/or the like are used as internal additives.

Examples of the material having an effect of decreasing viscosity in a low-temperature area include abietic acid, pimaric acid, rosin as a mixture thereof, esters such as diester phthalate, dioctyl phthalate, diester butanol, ester phosphate, or epoxydized fatty acid ester, silica with a volume average particle diameter smaller than 20 nm, metal oxide such as oxide of titanium or the like, and silicone resins with low compatibility with the binder resin. Rosin, dimethyl phthalate, silica with a volume average particle diameter smaller than 20 nm, and silicone resin are preferably used. Rosin is more preferably used in view of the suppression of the deterioration in halftone dot reproducibility due to uniform dispersion in the toner.

Examples of the material having an effect of increasing viscosity in a high-temperature area include silica with a volume average particle diameter of 20 nm or more, metal oxides such as oxide of titanium or the like, organic compounds with an azo group (hereinafter, referred to as "azo compound") represented by yellow pigments, resin particles with high polarity such as copolymer of acrylic acid and a polymerized monomer having a vinyl group, and a resin containing a large amount of gel-like materials. The azo compound is preferable in view of the suppression of the deterioration in halftone dot reproducibility due to uniform dispersion in the toner.

External additives are not particularly limited. Examples of the external additive include coupling agents, such as silane, titanate, and aluminate. Particularly, methyltrimethoxy silane is preferable in view of the suppression of the deterioration in halftone dot reproducibility due to a decrease in permeation of the toner.

Linear Thermal Expansion Coefficient

The toner has a linear thermal expansion coefficient in accordance with JIS K 7197-1991 (hereinafter, simply referred to as "linear thermal expansion coefficient") in the range of from $6\times10^{-5}$/° C. (or about $6\times10^{-5}$/° C.) to $1\times10^{-3}$/° C. (or about $1\times10^{-3}$/° C.).

By setting the linear thermal expansion coefficient of the toner to the above-mentioned range, in comparison with a toner for electrostatic latent image development having a linear thermal expansion coefficient in accordance with JIS K 7197-1991 departing from the range of from $6\times10^{-5}$/° C. to $1\times10^{-3}$/° C., the toner may become harder and the melting of the toner may thus be suppressed, thereby suppressing the deterioration in halftone dot reproducibility of the fixed image in the state where the fixing temperature is higher than the set temperature. Particularly, when the linear thermal expansion coefficient is $6\times10^{-5}$/° C. or more, the melting state of the toner in the end portion of the sheet may be less likely to vary, thereby suppressing the uneven gloss of an image.

The linear thermal expansion coefficient is a parameter of the toner containing toner particles and optional external additives externally added to the toner particles as needed.

The linear thermal expansion coefficient of the toner is preferably in the range of from $6\times10^{-5}$/° C. to $5\times10^{-4}$/° C., more preferably in the range of from $6\times10^{-5}$/° C. to $2\times10^{-4}$/° C., and still more preferably in the range of from $7\times10^{-5}$/° C. to $1\times10^{-4}$/° C.

The linear thermal expansion coefficient of the toner is a value measured on the basis of the measuring method in accordance with JIS K7197-1991, and is measured by a thermal mechanical analysis (TMA) method using a thermal mechanical analyzer TMA/SS6000 (manufacturer: Seiko Instruments Inc.).

Specifically, the linear thermal expansion coefficient is obtained as follows. The temperature of a cylindrical toner sample with a length of 10 mm and a diameter of 5 mm at a room temperature is raised in the atmosphere of nitrogen at a rising speed of 5° C./min, the length of the sample is measured soon after the rising of the temperature, and the linear thermal expansion coefficient is calculated using the following expression.

Linear thermal expansion coefficient [/° C.]=[sample length after temperature rising−sample length at room temperature (10 mm)]×100/[sample length at room temperature (10 mm)]

The toner having a desired linear thermal expansion coefficient is produced, for example, by adding the material having an effect of increasing viscosity in a high-temperature area, the material having an effect of decreasing viscosity in a low-temperature area, or the combination thereof at the time of producing the toner particles. More specifically, the toner can be produced by adding the above-mentioned material to the binder resin during the kneading of the toner components or adding a component compensating for the decrease in elasticity due to a decrease of a higher weight-average molecular weight part of the resin due to the kneading.

Examples of the material having an effect of increasing viscosity in a high-temperature area include silica with a volume average particle diameter of 20 nm or more, metal oxides such as oxide of titanium or the like, organic compounds having an azo group (azo compounds) represented by yellow pigments, resin particles with high polarity such as a copolymer of acrylic acid and a polymerized monomer having a vinyl group, and a resin containing a large amount of gel-like materials (for example, from 0.5% by weight to 10% by weight with respect to the overall weight of resin).

The azo compound, silica with a volume average particle diameter of 20 nm or more, polar particles, and a gel-like material are preferable, and the organic azo compound is more preferable.

Examples of the azo compound include yellow pigment, magenta pigment, and orange pigment. C.I. Pigment Yellow 180 can be used as the yellow pigment.

Examples of a combination of the binder resin, the release agent, and the material having an effect of increasing viscosity in a high-temperature area include a combination in which the resin has a glass-transition temperature in the range of from 35° C. to 50° C., paraffin is used as the release agent, and the azo compound is used as the material having an effect of increasing viscosity in a high-temperature area, a combination in which the binder resin has a glass-transition temperature of in the range of from 35° C. to 50° C., paraffin is used as the release agent, and the metal oxide is used as the material having an effect of increasing viscosity in a high-temperature area, a combination in which the binder resin has a glass-transition temperature of in the range of from 35° C. to 50° C., paraffin is used as the release agent, and the polar particles are used as the material having an effect of increasing viscosity in a high-temperature area, and a combination in which the binder resin has a glass-transition temperature of in the range of from 35° C. to 50° C., paraffin is used as the release agent, and the gel-like material is used as the material having an effect of increasing viscosity in a high-temperature area.

Among the combinations, the combination in which the binder resin has a glass-transition temperature of in the range of from 35° C. to 50° C., paraffin is used as the release agent, and the azo compound is used as the material having an effect of increasing viscosity in a high-temperature area is preferably used.

The content of the material having an effect of increasing viscosity in a high-temperature area in the toner is preferably in the range of from 0.1% by weight (or about 0.1% by weight) to 10% by weight (or about 10% by weight) with respect to the overall mass of the toner.

Examples of the material having an effect of decreasing viscosity in a low-temperature area include abietic acid, pimaric acid, rosin as a mixture thereof, esters such as diester phthalate, dioctyl phthalate, diester butanol, ester phosphate, or epoxydized fatty acid ester, silica with a volume-average particle diameter smaller than 20 nm, metal oxides such as oxide of titanium or the like, and silicone resins with low compatibility with the binder resin.

Among these, rosin, dimethyl phthalate, silica with a volume-average particle diameter smaller than 20 nm, and silicone resins are preferable, and rosin is more preferable.

Examples of a preferable combination of the binder resin, the release agent, and the material having an effect of decreasing viscosity in a low-temperature area include a combination in which the binder resin has a glass-transition temperature of in the range of from 35° C. to 50° C., paraffin is used as the release agent, and rosin is used as the material having an effect of decreasing viscosity in a low-temperature area, a combination in which the binder resin has a glass-transition temperature of in the range of from 35° C. to 50° C., paraffin is used as the release agent, and dimethyl phthalate is used as the material having an effect of decreasing viscosity in a low-temperature area, a combination in which the binder resin has a glass-transition temperature of the binder resin is in the range of from 35° C. to 50° C., paraffin is used as the release agent, and silica with a volume-average particle diameter smaller than 20 nm is used as the material having an effect of decreasing viscosity in a low-temperature area, and a combination in which the binder resin has a glass-transition temperature of in the range of from 35° C. to 50° C., paraffin is used as the release agent, and silicone resin is used as the material having an effect of decreasing viscosity in a low-temperature area, Among these combinations, the combination in which the binder resin has a glass-transition temperature of in the range of from 35° C. to 50° C., paraffin is used as the release agent, and rosin is used as the material having an effect of decreasing viscosity in a low-temperature area is preferably used.

The content of the material having an effect of decreasing viscosity in a low-temperature area in the toner is preferably in the range of from 0.1% by weight (or about 0.1% by weight) to 10% by weight (or about 10% by weight) with respect to the total weight of the toner.

When both the material having an effect of increasing viscosity in a high-temperature area and the material having an effect of decreasing viscosity in a low-temperature area are added to the toner particles, examples of a preferable combination of the material having an effect of increasing viscosity in a high-temperature area and the material having an effect of decreasing viscosity in a low-temperature area include a combination of azo compound and rosin, a combination of azo compound and dimethyl phthalate, a combination of azo compound and silica with a volume-average particle diameter smaller than 20 nm, and a combination of azo compound and silicone resin.

Examples of a combination with the binder resin and the release agent include a combination of the binder resin with a glass-transition temperature in the range of from 35° C. to 50° C., paraffin (release agent), and any of the above-described preferable combinations of the material having an effect of increasing viscosity in a high-temperature area and the material having an effect of decreasing viscosity in a low-temperature area.

When the powder characteristic of the toner is deteriorated by adding the material having an effect of decreasing viscosity in a low-temperature area to the toner, it is possible to suppress the deterioration in powder characteristic due to the material having an effect of decreasing viscosity in a low-temperature area by increasing the volume-average particle diameter at the time of pulverizing after melting and kneading the binder resin, the release agent, and the like, and cooling.

Shape Factor (SF1)

It is preferable that the toner particles have a shape factor (SF1) of from 145 to 170.

When the shape factor (SF1) of the toner particles is in the above-mentioned range, it is possible to further suppress the deterioration in halftone dot reproducibility of the fixed image, compared with the case where the shape factor is not in the range of from 145 to 170. The reason is described below in more detail.

When the shape factor (SF1) is equal to or greater than 145, it is thought that heat transmission at the time of heating and fixing is likely to be uneven and the rolling of the toner may be suppressed, thereby suppressing the deterioration in halftone dot reproducibility. When the shape factor (SF1) is equal to or less than 170, it is thought that the developing property or the transferability of the toner may be improved, thereby enabling the halftone dot reproducibility.

It is more preferable that the shape factor (SF1) of the toner particles is in the range of from 150 to 160.

The shape factor (SF1) is digitalized by analyzing a microscope image or a scanning electron microscope image by the use of an image analyzer and is calculated as follows. The shape factor (SF1) is obtained by inputting an optical microscope image of the toner applied onto a slide glass to an image analyzer LUZEX through a video camera, calculating the values of SF1 on 50 or more particles using the following expression, and averaging the values.

The shape factor of the toner particles approximates to the shape factor of the toner in which the external additive(s) are externally added to the toner particles.

$$SF1=(ML^2/A)\times(\pi/4)\times 100$$

Here, ML represents the absolute maximum length of the particle and A represents the projected area of the particle.

It is preferable that the volume-average particle diameter D50v of the toner particles is in the range of from 3.0 μm to 9.0 μm. When the volume-average particles diameter is in the above-mentioned range, the toner has a great adhesive force and an excellent developing property. In addition, the resolution of an image is improved. The volume-average particle diameter D50v of the toner particles is more preferably in the range of from 3.0 μm to 8.0 μm and still more preferably in the range of from 3.0 μm to 7.0 μm.

It is preferable that the volume-average particle size distribution index (GSDv) is 1.30 (or about 1.30) or less. When GSDv is equal to or less than 1.30, the resolution is good and image loss such as toner flying or fog are less likely to occur.

The number-average particle size distribution index (GSDp) of the toner is preferably equal to or less than 1.40, more preferably equal to or less than 1.31, and still more preferably in the range of from 1.20 to 1.27.

Here, the volume-average particle diameter D50v, the number-average particle size distribution index (GSDp), and the volume-average particle size distribution index (GSDv) are measured by a measuring device COULTER MULTISIZER (made by Coulter Inc.). The cumulative distributions from the smallest diameter of the volumes and numbers of the size ranges (channels) divided on the basis of the particle size distribution are drawn, the particle diameters corresponding to 16% in the cumulative distributions are defined as volume D16v and number D16p respectively, the particle diameters corresponding to 50% in the cumulative distributions are defined as volume D50v and number D50p respectively, and the particle diameters corresponding to 84% in the cumulative distributions is defined as volume D84v and number D84p respectively. By using these definitions, the volume-average particle size distribution index (GSDv) is calculated by $(D84v/D16v)^{1/2}$ and the number-average particle size distribution index (GSDp) is calculated by $(D84p/D16p)^{1/2}$.

Binder Resin

Examples of the binder resin used in the toner particles include ethylene resin such as polyethylene or polypropylene, styrene resin containing polystyrene or poly(α-methylstyrene) as a major component, (meth)acryl resin containing polymethyl (meth)acrylate or poly(meth)acrylonitrile as a major component, polyamide resin, polycarbonate resin, polyether resin, polyester resin, and copolymer resins thereof. One kind of the binder resin may be used singly or two or more kinds may be used in combination.

Polyester resin can be preferably used.

The method of producing polyester resin is not particularly limited, and an example thereof is to polymerize dicarboxylic acid and diol. Examples of diol include bisphenol A, bisphenol A ethylene oxide adduct, bisphenol A propylene oxide adduct, and hydrogen-added bisphenol A, and, when using such dial, the linear thermal expansion coefficient of the toner in the above-mentioned range may be easily obtained.

A cross-linking agent may be added to the binder resin as needed so as to further suppress the deterioration in halftone dot reproducibility.

Examples of the cross-linking agent include multivinyl aromatic compounds such as divinylbenzene and divinylnaphthalene, multivinylesters of aromatic polyvalent-carboxylic acid such as divinyl phthalate, divinyl isophthalate, divinyl terephthalate, divinyl homophthalate, trimesic acid divinyl/trivinyl, divinyl naphtalenedicarboxylate and divinyl biphenylcarboxylate, divinyl esters of nitrogen-containing aromatic compounds such as divinyl pyridinedicarboxylate, unsaturated heterocyclic compounds such as pyrrole, thiophene, vinyl esters of unsaturated heterocyclic compound carboxylic acid such as pyromucic acid vinyl, vinyl furancarboxylate, vinyl pyrrole-2-carboxylase, vinyl thiophenecarboxylate, (meth)acrylate esters of straight-chain polyhydric alcohol such as butanediol methacrylate, hexanediol acrylate, octanediol methacrylate, decanediol acrylate, decanediol methacrylate, (meth)acrylate esters of branched-substituted polyhydric alcohol such as neopentylglycol dimethacrylate, 2-hydroxy, 1,3-diacryloxypropane, polyethyleneglycol di(meth)acrylate, polypropylenepolyethyleneglycol di(meth)acrylates, and polyvinylesters of polycarboxylic acid such as divinyl succinate, divinyl fumarate, vinyl/divinyl maleate, divinyl diglycolate, vinyl/divinyl itaconate, divinyl acetonedicarboxylate, divinyl glutarate, divinyl 3,3'-thiodipropionate, divinyl/trivinyl trans-aconitate, divinyl adipate, divinyl pimelate, divinyl suberate, divinyl azelate, divinyl sebacate, dodecanedioic acid divinyl, and divinyl brassylate.

So long as it can be copolymerized, a compound having a hydrophilic polar group may be used as the polyester resin. When the compound having a hydrophilic polar group is used, it is possible to further increase or decrease the viscosity, relative to the material having an effect of increasing viscosity in the high-temperature area or the material having an effect of decreasing viscosity in the low-temperature area.

Examples the compound having a hydrophilic polar group include dicarboxylic acid compounds in which a sulfonyl group is directly attached to an aromatic ring such as sulfonylterephthalic acid sodium salt, 3-sulfonylisophthalic acid sodium salt or the like, and when the resin is a vinyl-based resin, specific examples the compound having a hydrophilic polar group include unsaturated aliphatic carboxylic acids such as (meth)acrylic acid and itaconic acid, esters such as those of alcohols and (meth)acrylates such as glycerin mono (meth)acrylate, aliphatic acid modified glycidyl(meth)acrylate, zinc mono(meth)acrylate, zinc di(meth)acrylate, 2-hydroxyethyl(meth)acrylate, polyethyleneglycol(meth) acrylate, and polypropyleneglycol(meth)acrylate, sulfonyl group-substituted aromatic vinyl such as styrene derivative having a sulfonyl group in any one of ortho, meta, and para positions, and sulfonyl group-containing vinylnaphthalene.

The glass-transition temperature (Tg) of the binder resin is preferably in the range of from 35° C. (or about 30° C.) to 50° C. (or about 50° C.).

When the glass-transition temperature (Tg) of the binder resin is in the above-mentioned range, it is possible to more easily control the linear thermal expansion coefficient, thereby further suppressing the deterioration in halftone dot reproducibility of the fixed image, in comparison with the case where Tg is not in the range of from 35° C. to 50° C. The reason is thought to be as follows.

When the glass-transition temperature of the binder resin is equal to or higher than 35° C., it is thought that the melting speed of the toner may be suppressed to suppress the degradation of the image due to the pressure at the time of pressing and fixing, thereby enabling the halftone dot reproducibility. When the glass-transition temperature of the binder resin is lower than 50° C., the melting of the toner may be less likely to vary among toners or among halftone dots, thereby suppressing the deterioration in halftone dot reproducibility of the fixed image. It is also thought that the unevenness in gloss of the end of the sheet may be suppressed.

The glass-transition temperature (Tg) of the binder resin is more preferably in the range of from 40° C. to 50° C.

The glass-transition temperature (Tg) of the binder resin is a value obtained by the measurement based on HS 7121-1987, the disclosure of which incorporated by reference herein, using a differential scanning calorimeter (DSC 3110, THERMAL ANALYSIS SYSTEM 001 made by Mc Science Inc.). The melting point of a mixture of indium and zinc is used to correct the temperature of a detector of an apparatus, and the melting heat of indium is used to correct the heat quantity. A sample (binder resin) is put into an aluminum pan, an aluminum pan having the sample and an empty aluminum pan for reference are set, and the measurement is made at a temperature rising rate of 10° C./min. The temperature of an intersection between extensions of a base line and a rising line in a heat absorbing section of the DSC curve acquired by the measurement is set as the glass-transition temperature.

The content of the binder resin in the toner particles is preferably in the range of from 40% by weight to 95% by weight with respect to the weight of the total solid content of the toner particles. When the content is in the above-mentioned range, the fusion of the toner particles may be suppressed. The content of the binder resin in the toner particles is more preferably in the range of from 50% by weight to 90% by weight and still more preferably in the range of from 60% by weight to 85% by weight.

Release Agent

The toner particles contain a release agent.

Examples of the release agent include low-molecular-weight polyolefins such as polyethylene, polypropylene, or polybutene; silicons having a softening point; aliphatic acid amides such as oleic acid amide, erucic acid amide, ricinoleic acid amide, stearic acid amide or the like; vegetable waxes such as carnauba wax, rice wax, candelilla wax, haze wax, jojoba oil or the like; animal-based waxes such as bees wax or the like; mineral and petroleum-based waxes such as montan wax, ozokerite, ceresin, paraffin wax, microcrystalline wax, Fischer-Tropsche wax or the like; ester waxes of a higher alcohol and a higher fatty acid such as stearyl stearate, behenyl behenate or the like; ester waxes of a monovalent or polyvalent lower alcohol and a higher fatty acid such as butyl stearate, propyl oleate, monostearic acid glyceride, distearic acid glyceride, pentaerythritol tetrabehenate or the like; ester waxes of a polyvalent alcohol multimeric complex and a higher fatty acid such as diethyleneglycol monostearate, dipropyleneglycol distearate, distearic acid diglyceride, tetrastearic acid triglyceride or the like; sorbitan higher fatty acid ester waxes such as sorbitan monostearate or the like; and cholesterol higher fatty acid ester waxes such as cholesteryl stearate or the like.

One kind of the release agents may be used singly or two or more kinds thereof may be used in combination.

Among these, hydrocarbon waxes are preferable. It is thought that the hydrocarbon wax is low in polarity, is less likely to be affected by the plasticization with resin having high polarity such as polyester resin, and may be advantageous for the reproducibility of halftone dots. The hydrocarbon wax is less likely to be affected by the plasticization with the resin depending on the polarity in comparison with the release agents other than the hydrocarbon wax and may easily provide the halftone dot reproducibility in the end portion of the sheet.

Among hydrocarbon waxes, mineral or petroleum-derived wax such as paraffin wax, micro-crystalline wax, or Fischer-Tropsch wax and polyalkylene waxes as modified substances thereof are preferable, in view of uniform elution to the surface of the fixed image at the time of fixing and an appropriate thickness of the release agent layer. Paraffin wax is more preferably used as the hydrocarbon wax.

The amount of release agent to be added is preferably in the range of from 1% by weight to 20% by weight and more preferably in the range of from 5% by weight to 15% by weight, with respect to the weight of the total solid content of the toner particles.

Colorant

The toner particles may contain colorant.

Pigment may be used as the colorant and dye may be used as needed.

Examples of the pigment used as the colorant include the followings.

Examples of the yellow pigment include chrome yellow, zinc yellow, yellow iron oxide, cadmium yellow, Chrome Yellow, hansa yellow, hansa yellow 10G, benzidine yellow G, benzidine yellow GR, threne yellow, quinoline yellow, and permanent yellow NCG. Specific examples thereof include C.I. Pigment Yellow 74, C.I. Pigment Yellow 180, and C.I. Pigment Yellow 93, and the C.I. Pigment Yellow 74 and the C.I. Pigment Yellow 180 are particularly preferable in view of pigment dispersibility and control of the linear expansion coefficient in the binder resin. As a yellow pigment, one kind of the above-mentioned pigments may be used singly or two or more kinds thereof may be used in combination.

Examples of the black pigment include carbon black, copper oxide, manganese dioxide, aniline black, activated carbon, nonmagnetic ferrite, and magnetite.

Examples of the orange pigment include red chrome yellow, molybdenum orange, permanent orange GTR, pyrazolone orange, balkan orange, benzidine orange GG, indanthrene brilliant orange RK, and indanthrene brilliant orange GK.

Examples of the red pigment include red ion oxide, cadmium red, red lead, mercury sulfide, watchung red, permanent red 4R, lithol red, brilliant carmine 3B, brilliant carmine 6B, du pont oil red, pyrazolone red, rhodamine B lake, lake red C, rose bengal, eoxine red, and alizarin lake.

Examples of the blue pigment include prussian blue, cobalt blue, alkali blue lake, Victoria blue lake, fast sky blue, indathrene blue BC, aniline blue, ultra marine blue, calco oil blue, methylene blue chloride, phthalocyanine blue, phthalocyanine green, and malachite green oxalate.

Examples of the purple pigment include manganese violet, fast violet B, and methyl violet lake.

Examples of the green pigment include chrome oxide, chrome green, pigment green, malachite green lake, and final yellow green G.

Examples of the white pigment include zinc oxide, titanium oxide, antimony white, and zinc sulfide.

Examples of the extender pigment include baryta powder, barium carbonate, clay, silica, white carbon, talc, and alumina white.

As dyes to be used as needed, various dyes such as a basic, acidic, dispersion, or direct dye can be used, and examples thereof include nigrosine, methylene blue, rose Bengal, quinoline yellow, and ultra marine blue. One kind of these dyes may be used singly or two or more kinds thereof may be used in combination, and these dyes may be used in a state of solid solution.

The content of the colorant to be added is preferably in the range of from 1 parts by weight to 20 parts by weight with respect to 100 parts by weight of resin.

When magnetic materials are used as the black colorant, the content of the magnetic materials to be added is preferably in the range of from 30 parts by weight to 100 parts by weight, unlike the other colorants.

Silica

It is preferable that the toner contains silica with a volume-average particle diameter of from 20 nm to 50 nm (hereinafter, referred to as "specific silica") by from 0.8% by weight (or about 0.8% by weight) to 3.0% by weight (or about 3.0% by weight). The specific silica is contained preferably as an external additive of the toner particles. When the toner contains from 0.8% by weight to 3.0% by weight of the specific silica, the toner may be excellent in fluidity and may further suppress the deterioration in halftone dot reproducibility of the fixed image. More specifically, this is thought to be as follows.

When the toner contains 0.8% by weight or more of the specific silica, the fluidity of the toner at the time of fixing the developed toner may be improved, whereby the fusion between the neighboring toner particles and the permeation of the toner into the sheet may be suppressed. As a result, the bleeding of the halftone dot image may be suppressed, and, therefore, the halftone dot reproducibility may be easily obtained. When the toner contains 3.0% by weight or less of the specific silica, the electrostatic repulsion between the toner particles and between the toner and the fixing member is less likely to occur, whereby the halftone dot reproducibility may be easily obtained.

The content of the specific silica in the toner is more preferably in the range of from 1.2% by weight to 2.0% by weight.

When the volume-average particle diameter of the specific silica is 50 nm or less, it is thought that it is possible to prevent the external additive containing the specific silica from being detached from the toner, thereby improving the transferability and the halftone dot reproducibility. When the volume-average particle diameter of the specific silica is 20 nm or more, it is thought that it is possible to prevent the external additive from being buried in the toner, thereby suppressing the deterioration of developability of the toner due to the variation in charged electricity and the deterioration of halftone dot reproducibility.

In view of the fluidity and the detachability control, it is more preferable that the volume-average particle diameter of the specific silica is in the range of from 20 nm to 30 nm. As a result, it is possible to further improve the halftone dot reproducibility.

The volume-average particle diameter of the specific silica is measured using a laser diffraction type size distribution measuring apparatus (LA-700 made by HORIBA Ltd.). In measurement, a sample in a state of a dispersion liquid is adjusted to be 2 g in terms of solid content and ion-exchange water is added to the resultant into a volume of 40 ml. This is introduced into a cell, 2 minutes elapses, and the measurement is made when the concentration in the cell is almost stable. The obtained volume-average particle diameters by channels are accumulated from the smallest, and when the cumulative amount becomes 50%, it is set as the volume-average particle diameter.

Other Components

Other components (particles) such as an internal additive, a charge control agent, organic particles, a lubricant, an abrading agent may be added to the toner as needed, in addition to the binder resin, the release agent, and the colorant. It should noted that some materials may cause an extreme change in the viscosity with the binder resin to affect the linear thermal expansion coefficient.

An example of the internal additive is magnetic powder. The magnetic powder can be contained when a magnetic toner is used as the toner. A material magnetized in a magnetic field is used as the magnetic powder, and examples thereof include metal such as ferrite, magnetite, reduced iron, cobalt, manganese, or nickel, alloys, and compounds containing the metals.

The charge control agent is not particularly limited, but a colorless or light-colored agent is preferably used for a color toner. Examples of the charge control agent include a dye containing a complex, such as a complex of quaternary ammonium salt compound, nigrosine compound, aluminum, iron, or chromium and triphenylmethane pigment.

Examples of the organic particles include all the particles typically used as the external additive to the toner surface, such as vinyl resin, polyester resin, or silicone resin. Such organic particles can be used as a fluidity aid or a cleaning aid.

Examples of the lubricant include fatty acid amides such as ethylene bisstearyl amide or oleic amide and metal salt of fatty acid such as zinc stearate or calcium stearate.

Examples of the abrading agent include silica, alumina, or cerium oxide

The content of the other components is not particularly limited as long as it does not adversely affect the goal of the exemplary embodiment, and is generally a very small amount. Specifically, the content is preferably in the range of from 0.01% by weight to 5% by weight and more preferably in the range of from 0.5% by weight to 2% by weight.

Toner Producing Method

The toner producing method according to the exemplary embodiment is not particularly limited. Toner particles are produced using a dry method such as a known kneading and pulverizing method or a wet method such as an emulsification and aggregation method or a suspension polymerization method, and external additives are added to the toner particles as needed. Among these methods, the kneading and pulverizing method is preferably used.

The kneading and pulverizing method is a method of producing toner particles by kneading a toner forming material containing the binder resin and the release agent to obtain a kneaded material and pulverizing the kneaded material. When the toner particles are produced using the kneading and pulverizing method to obtain the toner, convex portions of the toner surface can be more easily charged and the adhesion of the toner to the latent image may be enhanced, thereby further suppressing the deterioration in halftone dot reproducibility of the fixed image.

Specifically, the kneading and pulverizing method can be divided into a kneading process of kneading the toner forming materials containing the binder resin and the release agent and a pulverizing process of pulverizing the kneaded material. As needed, it may include other processes such as a cooling process of cooling the kneaded material formed in the kneading process.

The processes are described below in detail.

Kneading Process

In the kneading process, the toner forming material containing the binder resin and the release agent is kneaded.

In the kneading process, an aqueous medium (for example, water such as distilled water or ion-exchange water, or an alcohol) is preferably added by from 0.5 parts by weight to 5 parts by weight with respect to 100 parts by weight of the toner forming material.

Examples of a kneading machine used in the kneading process include a single-screw extruder and a double-screw extruder. Hereinafter, a kneading machine including a transport screw section and two kneading parts is described as an example of the kneading machine with reference to the drawing, but the invention is not limited to this kneading machine.

FIG. 1 is a diagram illustrating a state of a screw in an example of a screw extruder used in the kneading process of the toner producing method according to this exemplary embodiment.

The screw extruder 11 includes a barrel 12 including a screw (not shown), an injection port 14 for injecting a toner forming material as a raw material of the toner into the barrel 12, a liquid adding port 16 for adding an aqueous medium to the toner forming material in the barrel 12, and a discharge port 18 for discharging a kneaded material formed by kneading the toner forming material in the barrel 12.

The barrel 12 includes, sequentially from the closest to the injection port 14, a transport screw section SA for transporting the toner forming material injected from the injection port 14 to a kneading section NA, a kneading section NA for melting and kneading the toner forming material by a first kneading process, a transport screw section SB for transporting the toner forming material melted and kneaded by the kneading section NA to a kneading section NB, a kneading section NB for melting and kneading the toner forming material by a second kneading process to form a kneaded material, and a transport screw section SC for transporting the kneaded material to the discharge port 18.

In the barrel 12, each block has a different temperature control unit (not shown). That is, block 12A to block 12J can be controlled to different temperatures. FIG. 1 shows a state where the temperature of block 12A and block 12B is controlled to t0° C., the temperature of block 12C to block 12E is controlled to t1° C., and the temperature of block 12F to block 12J is controlled to t2° C. Accordingly, the toner forming material in the kneading section NA is heated to t1° C. and the toner forming material in the kneading section NB is heated to t2° C.

When the toner forming material containing the binder resin, the release agent, and the colorant as needed is supplied to the barrel 12 via the injection port 14, the toner forming material is sent to the kneading section NA by the transport screw section SA. At this time, since the temperature of block 12C is set to t1° C., the toner forming material is heated and melted and is transported to the kneading section NA in the melted state. Since the temperature of block 12D and block 12E is also set to t1° C., the kneading section NA melts and kneads the toner forming material at the temperature of t1° C. The binder resin and the release agent are melted by the kneading section NA and are sheared by the screw.

Subsequently, the toner forming material kneaded by the kneading section NA is transported to the kneading section NB by the transport screw section SB.

Then, the aqueous medium is added to the toner forming material by injecting the aqueous medium into the barrel 12 through the liquid adding port 16 in the transport screw section SB. In FIG. 1, the aqueous medium is injected into the transport screw section SB, but the invention is not limited to this configuration. The aqueous medium may be injected into the kneading section NB or the aqueous medium may be injected into both the transport screw section SB and the kneading section NB. That is, the position at which the aqueous medium is injected is selected as needed.

As described above, by injecting the aqueous medium into the barrel 12 through the liquid adding port 16, the toner forming material in the barrel 12 is mixed with the aqueous medium and the toner forming material is cooled by the latent heat of vaporization of the aqueous medium, whereby the temperature of the toner forming material is appropriately maintained.

Finally, the kneaded material melted and kneaded by the kneading section NB is transported to the discharge port 18 by the transport screw section SC and is discharged from the discharge port 18.

In this way, the kneading process is performed using the screw extruder 11 shown in FIG. 1.

Cooling Process

The cooling process is a process of cooling the kneaded material formed in the kneading process. In the cooling process, it is preferable that the kneaded material is cooled to 40° C. or less at an average temperature-dropping rate of 4° C./sec or higher from the temperature of the kneaded material at the time of end of the kneading process. When the cooling speed of the kneaded material is low, the mixture (mixture of the release agent and internal additives such as the colorant internally added to the toner particles as needed) finely dispersed in the binder resin in the kneading process is re-crystallized, whereby the dispersion diameter may increase. On the other hand, when rapidly cooling at the average temperature-dropping rate, the dispersion state just after the kneading process may be maintained without any change, which is preferable. The average temperature-dropping rate means an average value of the rates lowering the temperature from the temperature of the kneaded material at the end of the kneading process (for example, t2° C. when the screw extruder 11 shown in FIG. 1 is used) to 40° C.

Example of the cooling method used in the cooling process include a method using a stretch roll in which cold water or brine is circulated and a wedge-type cooling belt. When the cooling process is performed using this method, the cooling rate is determined depending on the speed of the stretch roll, the flow rate of the brine, the amount of the kneaded material supplied, the thickness of the slab at the time of rolling the kneaded material. The thickness of the slab is preferably in the range of from 1 to 3 mm.

Pulverizing Process

The kneaded material cooled in the cooling process is pulverized in the pulverizing process to form toner particles. For example, a mechanical pulverizer or a jet pulverizer is used in the pulverizing process.

Classification Process

The toner particles obtained in the pulverizing process may be classified in the classification process as needed to obtain toner particles with a target volume-average particle diameter. A conventional centrifugal classifier or a conventional inertial classifier may be used in the classification process, whereby fine powders (toner particles having a diameter smaller than a target diameter) and coarse powders (toner particles having a diameter greater than a target diameter) are removed.

External Addition Process

For the purpose of charging control, imparting fluidity, imparting charge exchange property, or the like, inorganic particles such as the specific silica, titania, and alumina, in addition to the inorganic oxide added in the pulverizing process, may be added to the obtained toner particles. This addition is performed, for example, using a V-shaped blender, a HENSCHEL mixer, or a LOEDIGE mixer and the inorganic particles are attached step by step.

Known methods can be used as the method for surface modification. Specific examples thereof include a coupling treatment of, for example, silane, titanate, or aluminate. The coupling agent used in the coupling treatment is not particularly limited, examples thereof include methyltrimethoxy silane.

Sieving Process

A sieving process may be performed after the external addition process as needed. For example, a gyrosifter, a vibration sifter, or a wind sifter can be used in the sieving process. The coarse powders of the external additives are removed by sieving, thereby suppressing the generation of stripes and stains.

Electrostatic Latent Image Developer

The electrostatic latent image developer at least includes the above described toner for electrostatic latent image development.

The toner for electrostatic latent image development may be used as a one-component developer as it is or may be used in a two-component developer. When the toner for electrostatic latent image development is used in the two-component developer, the toner is mixed with a carrier.

The carrier usable in the two-component developer is not particularly limited, and any known carrier may be used. Examples of the carrier include iron oxide, magnetic metals, such as nickel or cobalt, magnetic oxides, such as ferrite or magnetite, a resin-coated carrier having a resin-coating layer on the surface of the core material thereof, and a magnetic dispersion type carrier. Examples of the carrier further include a resin dispersion type carrier in which a conductive material or the like is dispersed in a matrix resin.

The mixing ratio of toner and carrier (toner:carrier, weight ratio) in the two-component developer is preferably from 1:100 to 30:100, and more preferably from 3:100 to 20:100.

Image Forming Apparatus

The image forming apparatus in which the toner for electrostatic latent image development is used is described.

The image forming apparatus includes: a latent image holding member; a charging unit that charges the surface of the latent image holding member; an electrostatic latent image forming unit that forms an electrostatic latent image on the surface of the electrostatic latent image holding member; a developing unit that develops the electrostatic latent image with an electrostatic latent image developer to form a toner image; a transfer unit that transfers the toner image to a recording medium; and a fixing unit that fixes the toner image to the recording medium. In the image forming apparatus, as the electrostatic latent image developer, the above described electrostatic latent image developer is used.

Hereinafter, an example of the image forming apparatus according to the exemplary embodiment is described, but the exemplary embodiment is not limited thereto. The main portions shown in the drawings are described and the description of other portions is omitted.

In the image forming apparatus, for example, a section including the developing unit may be a cartridge structure (process cartridge) which is attachable to and detachable from the image forming apparatus body. A process cartridge which includes a developing unit that stores the above-mentioned electrostatic latent image developer and develops an electrostatic latent image formed on a latent image holding member with the electrostatic latent image developer to form a toner image and which can be attached to and detached from the image forming apparatus can be preferably used as the process cartridge.

Figure 2:
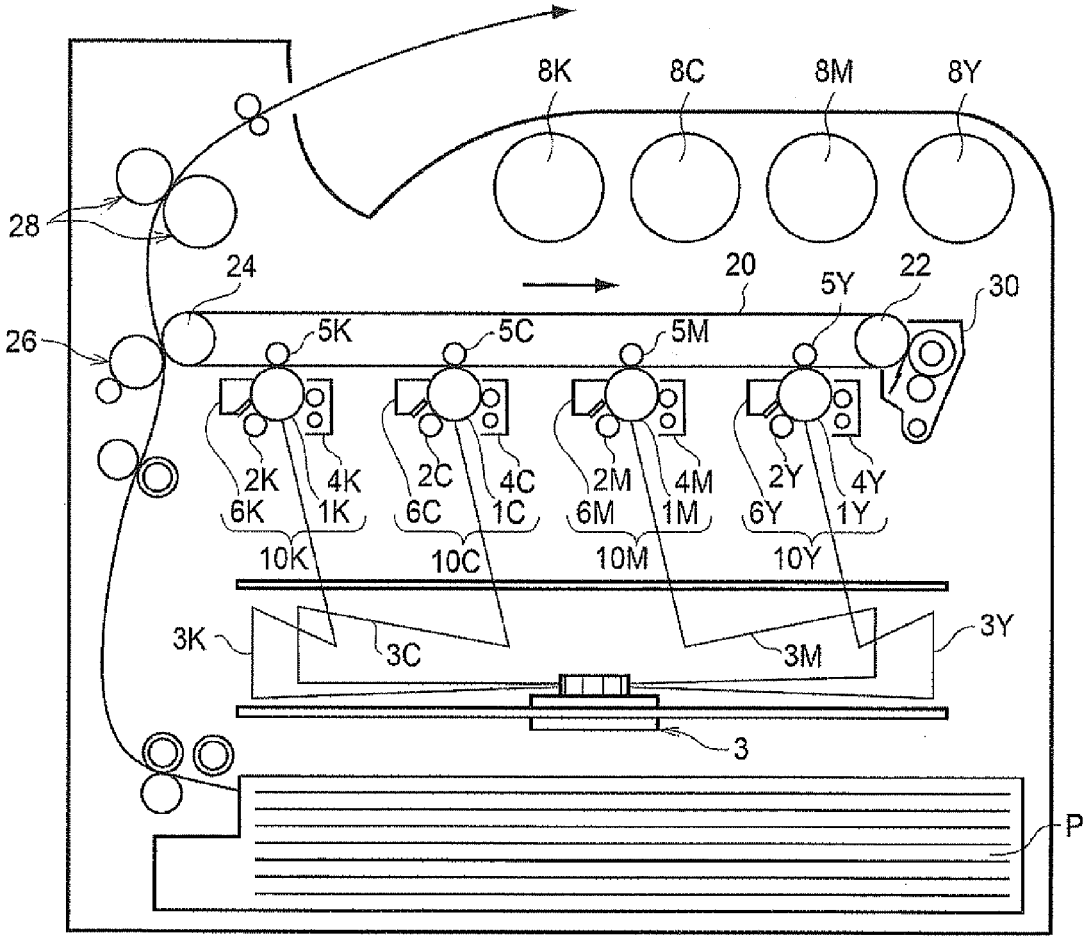
FIG. 2 is a diagram schematically illustrating the configuration of an image forming apparatus according to the exemplary embodiment of the invention.

FIG. 2 is a diagram schematically illustrating the configuration of a 4-rum tandem color image forming apparatus as an example of the image forming apparatus according to the exemplary embodiment. The image forming apparatus shown in FIG. 2 includes first to fourth image forming units 10Y, 10M, 10C, and 10K of electrophotographic type outputting color images of yellow (Y), magenta (M), cyan (C), and black (K) based on color-separated image data (image forming unit). The image forming units (hereinafter, simply referred to as "units") 10Y, 10M, 10C, and 10K are arranged with a predetermined distance therebetween in the horizontal direction. The units 10Y, 10M, 10C, and 10K may be process cartridges which can be attached to or detached from the image forming apparatus body.

In FIG. 2, in the units 10Y, 10M, 10C, and 10K, reference numerals 1Y, 1M, 1C, and 1K represent photoreceptors (image holding member), reference numerals 2Y, 2M, 2C, and 2K represent charging rollers, reference numerals 3Y, 3M, 3C, and 3K represent laser beams, reference numerals 4Y, 4M, 4C, and 4K represent developing devices (developing units), reference numerals 5Y, 5M, 5C, and 5K represent primary transfer rollers, reference numerals 6Y, 6M, 6C, and 6K represent photoreceptor cleaning devices (cleaning units), and reference numerals 8Y, 8M, 8C, and 8K represent toner cartridges.

An intermediate transfer belt 20 as an intermediate transfer member of the units extends above the units 10Y, 10M, 10C, and 10K in the drawing. The intermediate transfer belt 20 is wound on a driving roller 22 and a support roller 24 contacting the inner surface of the intermediate transfer belt 20, which are separated from each other on the left and right sides in the drawing, and travels from the first unit 10Y to the fourth unit 10K. A force in the direction in which it is separated from the driving roller 22 is applied to the support roller 24 by a spring or the like not shown, thereby applying a tension to the intermediate transfer belt 20 wound on both rollers. An intermediate transfer member cleaning device 30 is disposed at the image holding member side of the intermediate transfer belt 20, so as to face the driving roller 22.

The developing devices (developing units) 4Y, 4M, 4C, and 4K of the units 10Y, 10M, 10C, and 10K are supplied with toners of four colors of yellow, magenta, cyan, and black contained in the toner cartridges 8Y, 8M, 8C, and 8K, respectively.

The first to fourth units 10Y, 10M, 10C, and 10K have the same configuration, and thus only the first unit 10Y for forming a yellow image disposed upstream in the traveling direction of the intermediate transfer belt is described as a representative. The same elements as the first unit 10Y are referenced by reference numerals having magenta (M), cyan (C), and black (K) added instead of yellow (Y), and the second to fourth units 10M, 10C, and 10K are not described.

The first unit 10Y includes the photoreceptor 1Y serving as an image holding member. Around the photoreceptor 1Y, a charging roller 2Y charging the surface of the photoreceptor 1Y to a predetermined potential, an exposure device (electrostatic latent image forming unit) 3 exposing the charged surface with a laser beam 3Y based on a color-separated image signal to form an electrostatic latent image, a developing device (developing unit) 4Y supplying a charged toner to the electrostatic latent image to develop the electrostatic latent image, a primary transfer roller (primary transfer unit) 5Y transferring the developed toner image onto the intermediate transfer belt 20, and a photoreceptor cleaning device (cleaning unit) 6Y removing the toner remaining on the surface of the photoreceptor 1Y after the primary transfer, are arranged in this order.

The primary transfer roller 5Y is disposed inside the intermediate transfer roller 20 and is located at a position opposed to the photoreceptor 1Y. Bias sources (not shown) applying a primary transfer bias are connected to the primary transfer rollers 5Y, 5M, 5C, and 5K, respectively. The bias sources vary the transfer bias applied to the primary transfer rollers under the control of a controller not shown.

The operation of forming a yellow image in the first unit 10Y is described below. First, before the operation, the surface of the photoreceptor 1Y is charged to a potential of from −600 V to −800 V by the charging roller 2Y.

The photoreceptor 1Y includes a photosensitive layer disposed on a conductive base (with a volume resistivity of $1\times10^{-6}$ Ωcm or less at 20° C.). This photosensitive layer typically has high resistance (corresponding to the resistance of general resin), but has a feature that the specific resistance of a part to which a laser beam is applied changes when the laser beam 3Y is applied thereto. Here, the laser beam 3Y is emitted to the surface of the charged photoreceptor 1Y from the exposure device 3 in accordance with yellow image data sent from the controller not shown. The laser beam 3Y is applied to the photosensitive layer on the photoreceptor 1Y, whereby an electrostatic latent image of a yellow print pattern is formed on the surface of the photoreceptor 1Y.

The electrostatic latent image is an image formed on the surface of the photoreceptor 1Y by the charging, and is a so-called negative latent image which is formed by applying the laser beam 3Y to a part of the photosensitive layer to lower the specific resistance of the applied part to cause charges to flow on the surface of the photoreceptor 1Y while charges remain in the part to which the laser beam 3Y is not applied.

The electrostatic latent image formed on the photoreceptor 1Y is rotated to a predetermined developing position with the rotation of the photoreceptor 1Y. The electrostatic latent image on the photoreceptor 1Y is visualized (to form a developed image) at the developing position by the developing device 4Y.

An electrostatic latent image developer containing at least a yellow toner and a carrier is contained in the developing device 4Y. The yellow toner is frictionally charged by the agitation in the developing device 4Y to have charges with the same polarity (negative polarity) as the electrified charges on the photoreceptor 1Y and is held on the developer roller (developer holder). By causing the surface of the photoreceptor 1Y to pass through the developing device 4Y, the yellow toner is electrostatically attached to the latent image part having no charge on the photoreceptor 1Y, whereby the latent image is developed with the yellow toner.

In view of the developing efficiency, the image granularity, the tone reproducibility, or the like, a bias potential (developing bias) in which an AC component is superposed on a DC component may be applied to the developer holder. Specifically, when the DC voltage Vdc applied to the developer holder is in the range of from −300 to −700 V, the peak width Vp-p of the AC voltage applied to the developer holder may be set to the range of from 0.5 to 2.0 kV.

The photoreceptor 1Y having a yellow toner image formed thereon travels continuously at a predetermined speed and the toner image developed on the photoreceptor 1Y is carried to a predetermined primary transfer position.

When the yellow toner image on the photoreceptor 1Y is carried to the primary transfer position, the primary transfer bias is applied to the primary transfer roller 5Y and an electrostatic force in the direction from the photoreceptor 1Y to the primary transfer roller 5Y acts on the toner image, whereby the toner image on the photoreceptor 1Y is transferred to the intermediate transfer belt 20. The transfer bias applied at this time has the opposite polarity (+) of the toner polarity (−) and is controlled to be about +10 μA in the first unit 10Y by the controller (not shown).

On the other hand, the toner remaining on the photoreceptor 1Y is removed and recovered by the cleaning device 6Y.

The primary transfer biases applied to the primary transfer rollers 5M, 5C, and 5K of from the second unit 10M and the subsequent units thereof are controlled similarly to the first unit.

In this way, the intermediate transfer belt 20 onto which the yellow toner image is transferred in the first unit 10Y is sequentially carried through the second to fourth units 10M, 10C, and 10K and the toner images of the colors are transferred in a multi-layered manner thereto.

The intermediate transfer belt 20 onto which four color toner images are transferred in a multi-layer manner by the first to fourth units reaches a secondary transfer unit including the intermediate transfer belt 20, the support roller 24 contacting the inner surface of the intermediate transfer belt, and a secondary transfer roller (secondary transfer unit) 26 disposed on the image holding side of the intermediate transfer belt 20. On the other hand, a recording sheet (recording medium) P is fed to a pressed gap between the secondary transfer roller 26 and the intermediate transfer belt 20 at a predetermined time by a feed mechanism and the secondary transfer bias is applied to the support roller 24. The transfer bias applied at this time has the same polarity (−) as the toner polarity (−) and an electrostatic force in the direction from the intermediate transfer belt 20 to the recording sheet P acts on the toner image, whereby the toner image on the intermediate transfer belt 20 is transferred onto the recording sheet P. The secondary transfer bias is determined depending on the resistance detected by a resistance detector (not shown) detecting the resistance of the secondary transfer unit and is voltage-controlled.

Thereafter, the recording sheet P is fed to a pressing portion (nip) between a pair of fixing rollers in the fixing device (roll-like fixing unit) 28, the toner image is heated, and the toner image in which colors are disposed in a layered manner is melted and fixed onto the recording sheet P.

Examples of the recording medium onto which the toner image is transferred include a plain paper and an OHP sheet used in a copier or a printer of an electrophotographic type.

The recording sheet P onto which the color image has been fixed is fed to the discharge unit and a series of color image forming operations is ended.

Although the image forming apparatus as described above as an example has the configuration in which the toner image is transferred to the recording sheet P via the intermediate transfer belt 20, the apparatus is not limited to this configuration. The apparatus may have a structure in which the toner image is transferred directly to the recording sheet from the photoreceptor.

Process Cartridge, Toner Cartridge

Figure 3:
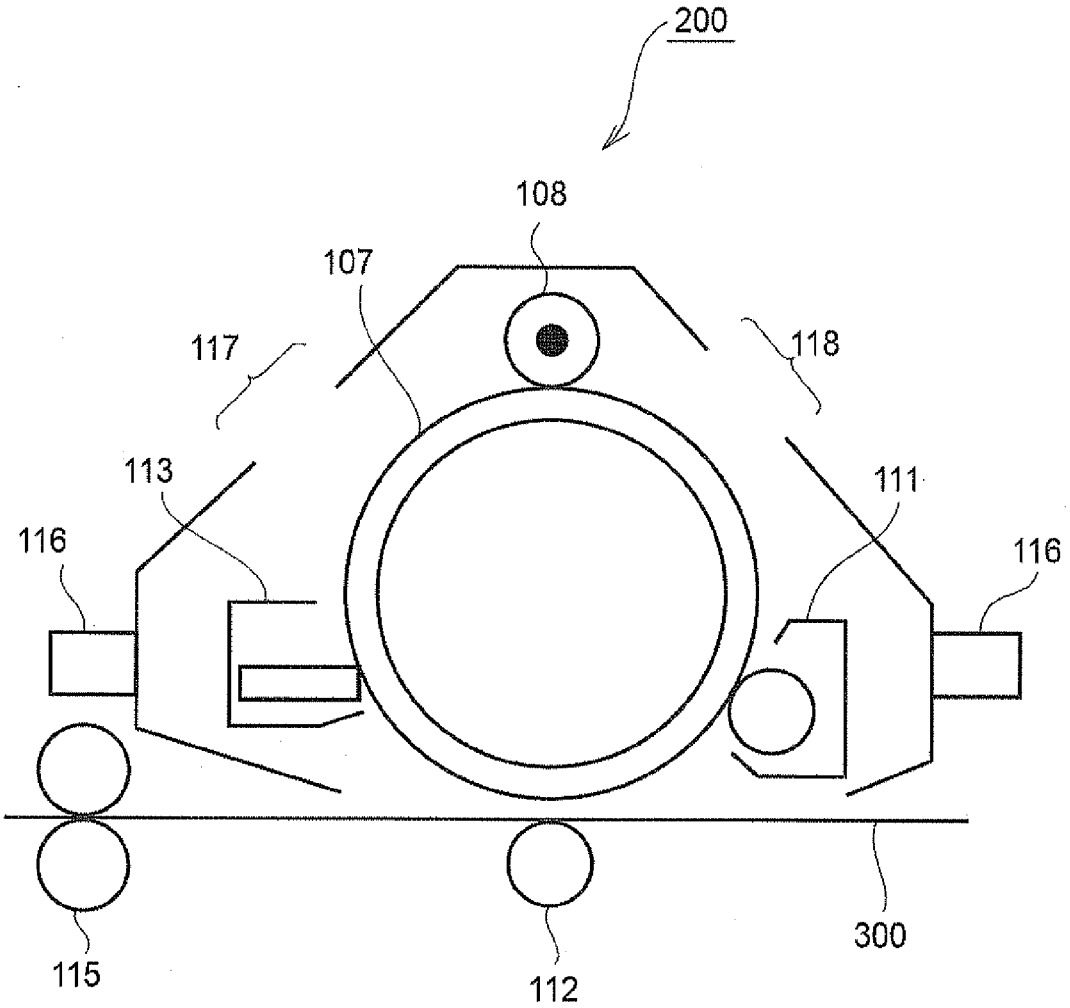
FIG. 3 is a diagram schematically illustrating the configuration of a process cartridge according to the exemplary embodiment of the invention.

FIG. 3 is a diagram schematically illustrating an example of the process cartridge that stores the electrostatic latent image developer according to the exemplary embodiment. The process cartridge 200 includes a developing device 111, a photoreceptor 107, a charging roller 108, a photoreceptor cleaning device 113, an exposure opening 118, and a charge-erasing exposure opening 117, which are combined into one unit using a mounting rail 116. Reference numeral 300 in FIG. 3 represents a recording medium.

The process cartridge 200 can be attached to and detached from the image forming apparatus body including a transfer device 112, a fixing device 115, and other elements not shown, and the image forming apparatus body and the process cartridge 200 forms an image forming apparatus.

The process cartridge 200 shown in FIG. 3 includes the photoreceptor 107, the charging device 108, the developing device 111, the cleaning device 113, the exposure opening 118, and the charge-erasing exposure opening 117, but these elements may be selectively combined. The process cartridge according to the exemplary embodiment may include the developing device 111 and at least one selected from the group consisting of the photoreceptor 107, the charging device 108, the cleaning device (cleaning unit) 113, the exposure opening 118, and the charge-erasing exposure opening 117.

A toner cartridge is described.

The toner cartridge is detachably attached to the image forming apparatus and stores the toner to be supplied to the developing unit disposed in the image forming apparatus. In the toner cartridge, the toner for electrostatic latent image development is contained as the toner. The toner cartridge stores at least a toner, and the toner cartridge may store, for example, a developer, depending on the mechanism of the image forming apparatus.

Accordingly, in the image forming apparatus having a structure in which a toner cartridge is attachable to and detachable from the image forming apparatus, the toner for electrostatic latent image development can be easily supplied to the developing device using the toner cartridge storing the toner for electrostatic latent image development.

The image forming apparatus shown in FIG. 2 is an image forming apparatus having the structure in which the toner cartridges 8Y, 8M, 8C, and 8K can be attached thereto and detached therefrom. The developing devices 4Y, 4M, 4C, and 4K are connected to the toner cartridges corresponding to the developing devices (colors) via toner supply pipes not shown, respectively. When the amount of the toner stored in a toner cartridge has decreased, the toner cartridge may be replaced.

Examples

Hereinafter, the exemplary embodiment is described with reference to Examples, but the exemplary embodiment is not limited to the following Examples. In the following, unless otherwise specified, "part(s)" and "%" mean "part(s) by weight" and "% by weight", respectively.

Examples

Measurement of Physical Property

The linear thermal expansion coefficient of the toner, the shape factor SF1 of the toner particles, the volume-average particle diameter, and the glass-transition temperature are measured by the use of the above-mentioned devices and techniques.

The weight-average molecular weight of the binder resin is measured by gel permeation chromatography (GPC). The molecular weight measurement using GPC is performed using GPC HLC-8120 made by Tosoh Corporation as measuring equipment, using column TSKGEL SUPER HM-M (15 cm) made by Tosoh Corporation, and using a THF solvent. The weight-average molecular weight is calculated from the measurement result using a molecular weight correcting curve prepared for a monodispersed polystyrene standard sample.

The amount of the externally-added silica on the toner surface is measured by XPS (X-ray photoelectron spectroscopy). The measuring conditions using the XPS are set as follows.

X-ray photoelectron spectrometer: JPS-9000MX made by JEOL Ltd.

X-ray source: MgKα ray

Acceleration voltage: 10.0 kV

Emission current: 20 mA

Pass energy of photoelectron energy analyzer: 30 V

The surface atom concentrations were calculated from the peak strengths of the elements Si, C, and Ti (the place of 1000 is rounded in consideration of the measurement error). The calculation of the surface atom concentrations is performed using the relative photosensitive factor provided from JASCO Corp. The background correction and area are guided by an analysis application software made by JEOL Ltd.

Production of Toner

Synthesis of Binder Resin 1

The polyhydric alcohol components and the polyhydric carboxylic acid components in the compositions shown in Table 1 respectively are introduced into a round-bottomed flask provided with an agitator, a nitrogen introduction pipe, a temperature sensor, and a rectifying column, and the temperature is raised to 200° C. using a mantle heater. Subsequently, nitrogen gas is introduced via the nitrogen introduction pipe and the contents in the flask is agitated while the inside of the flask is maintained in the inert gas atmosphere. Thereafter, 0.05 parts of dibutyl tin oxide with respect to 100 parts of a raw material mixture is added and the reactants are allowed to a reaction for a predetermined time while the temperature of the reactants is maintained at 200° C., whereby binder resins 1 to 7 are obtained. The details are shown in Table 1.

Physical properties of the resins are also shown in Table 1.

TABLE 1

| | | resin 1 | resin 2 | resin 3 | resin 4 | resin 5 | resin 6 | resin 7 |
|---|---|---|---|---|---|---|---|---|
| alcohol component | BPA-EO | 20 | 40 | 40 | 40 | 40 | 10 | — |
| | BPA-PO | 20 | — | — | — | — | 30 | 40 |
| | ethylene glycol | 10 | 10 | 10 | 10 | 10 | 10 | 10 |
| carbonate component | terephthalic acid | 45 | 38 | 40 | 42 | 45 | 45 | 45 |
| | fumaric acid | 5 | 12 | 10 | 8 | 5 | 5 | 5 |
| resin Tg | | 44° C. | 34° C. | 35° C. | 36° C. | 40° C. | 48° C. | 51° C. |

In Table 1, BPA-EO is an ethylene oxide adduct of bisphenol A (polyoxyethylene(2.0)-2,2-bis(4-hydroxy phenyl) propane)) and BPA-PO is a propylene oxide adduct of bisphenol A (polyoxyethylene(2.2)-2,2-bis(4-hydroxy phenyl) propane).

The unit used for the alcohol component and the carbonate component is mol %.

As the result of molecular weight measurement (in terms of polystyrene) using GPC, the obtained weight-average molecular weight (Mw) of binder resin 1 is 9500 and the number-average molecular weight (Mn) is 4200. The DSC spectrum of binder resin 1 is measured using the differential scanning calorimeter (DSC), in which no clear peak is observed and step-like change in absorbed heat quantity is observed. The glass-transition temperature obtained as a middle point in the step-like change in absorbed heat quantity is 44° C.

Production of Toner 1

Binder resin 1: 88 parts

Release agent: 5 parts (paraffin wax made by NIPPON SEIRO Co., Ltd.: HNP-9)

Colorant: 5 parts (carbon black (CB) (trade name: REGAL 330; made by CABOT)

40 nm silica: 1 part (OX-50 (trade name) made by NIPPON AEROSIL Co., Ltd.)

rosin: 1 part (HARTALL RX(trade name) made by HARIMA CHEMICALS Inc.)

These components are blended by a 75 L HENSCHEL mixer and are then kneaded under the following conditions by the use of the continuous kneader (two-screw extruder) having the screw structure shown in FIG. 1. The number of revolutions of the screw is 500 rpm.

Set temperature of feed section (blocks 12A and 12B): 20° C.

Set temperature for kneading of kneading section 1 (blocks 12C to 12E): 90° C.

Set temperature for kneading of kneading section 2 (blocks 12F to 12J): 115° C.

Amount of aqueous medium (distilled water) added: 1.5 parts with respect to 100 parts by weight of supplied raw material The temperature of the kneaded material in the discharge port (discharge port 18) is 125° C.

The kneaded material is rapidly cooled with a roller in which brine of −5° C. is passing through and a slab wedge-type cooling belt using cold water of 2° C., and is pulverized with a hammer mill after the cooling. The rapid cooling rate is checked by changing the speed of the cooling belt and the average temperature-dropping rate is 10° C./sec.

Thereafter, the obtained product is pulverized by a pulverizer (AFG400: trade name) provided with a built-in coarse powder classifier to obtain pulverized particles. Thereafter, the obtained pulverized particles are classified by an inertial classifier and the fine powders and the coarse powders are removed, thereby obtaining toner particles 1.

The shape factor of the obtained toner particles 1 is 155.

1.0 parts by weight of 30 nm silica (which is obtained by surface-treating MOX (trade name), made by NIPPON AEROSIL CO., LTD., with isobutyl methoxy silane) and 0.5 parts by weight of 16 nm silica (R972 (trade name) made by NIPPON AEROSIL CO., LTD.) are added to the obtained toner particles and these are mixed with a HENSCHEL mixer for 3 minutes (edge speed of a rotating blade of 22 m/s), thereby obtaining toner 1.

The measured linear thermal expansion coefficient of the obtained toner 1 is $1.0\times10^{-4}$/° C. and the content of 50 nm or less silica is 2.5% as the result of XPS measurement. The results are shown in Table 2.

Production of Toner 2

Toner particles 2 are produced in a manner similar to toner particles 1, except that azo compound (C.I. Pigment Yellow 180, Novoperm P-HG (trade name) made by Client Japan) is used instead of 40 nm silica used in toner 1. 30 nm silica and 16 nm silica are externally added under the conditions similar to toner particles 1, thereby obtaining toner 2.

The shape factor of the obtained toner particles 2, the linear thermal expansion coefficient of toner 2, and the silica content are shown in Table 2.

Production of Toner 3

Toner particles 3 are produced in a similar manner to toner particles 1, except that resin particles having polarity as described below are used instead of 40 nm silica used in toner 1. 30 nm silica and 16 nm silica are externally added under the conditions similar to toner particles 1, thereby obtaining toner 3.

The shape factor of the obtained toner particles 3, the linear thermal expansion coefficient of toner 3, and the silica content are shown in Table 2.

Production of Resin Particles having Polarity

The resin dispersed solution 3 described in JP-A No. 2003-55153 is separated into solid and liquid by centrifugal separation. 100 parts of ion-exchange water are added to 10 parts of solid, and this mixture is dispersed, and is separated into solid and liquid again by centrifugal separation. The operations from the dispersion in ion-exchange water to the solid-liquid separation are performed six times and the resulting product is then dried (at 40° C. for 12 hours) with a vacuum freeze drier, thereby obtaining resin particles having polarity.

Production of Toner 4

Toner particles 4 are produced in a manner similar to toner particles 1, except that the gel-like material as described below is used instead of 40 nm silica used in toner 1. 30 nm silica and 16 nm silica are externally added under the conditions similar to toner particles 1, thereby obtaining toner 4.

The shape factor of the obtained toner particles 4, the linear thermal expansion coefficient of toner 4, and the silica content are shown in Table 2.

Production of Gel-like Material 10 parts by mol of polyoxyethylene(2.0)-2,2-bis(4-hydroxyphenyl) propane, 90 parts by mol of polyoxyethylene (2.2)-2,2-bis(4-hydroxyphenyl) propane, 10 parts by mol of terephthalic acid, 60 parts by mol of fumaric acid, 30 parts by weight of trimellitic acid, 0.05 parts by mol of dibutyl tin oxide with respect to these acid components (the total number of moles of terephthalic acid, n-dodecenyl succinic acid, trimellitic acid, and fumaric acid) are introduced into a two-necked flask, which has been heated and dried. To this flask, nitrogen gas is introduced, and while the inert gas atmosphere is maintained in the inside of the flask, the temperature of the inside of the flask is raised. Then, co-condensation polymerization reaction is performed at 180° C. for 12 hours, and, thereafter, the pressure of the inside of the flask is slowly decreased at 230° C., whereby the gel-like material is obtained.

Production of Toner 5

Toner particles 5 are produced in a manner similar to toner particles 1, except that dimethyl phthalate is used instead of rosin used in toner 1. 30 nm silica and 16 nm silica are externally added under the conditions similar to toner particles 1, thereby obtaining toner 5.

The shape factor of the obtained toner particle 5, the linear thermal expansion coefficient of toner 5, and the silica content are shown in Table 2.

Production of Toner 6

Toner particles 6 are produced in a manner similar to toner particles 2, except that dimethyl phthalate is used instead of rosin used in toner 2. 30 nm silica and 16 nm silica are externally added under the conditions similar to toner particles 2, thereby obtaining toner 6.

The shape factor of the obtained toner particles 6, the linear thermal expansion coefficient of toner 6, and the silica content are shown in Table 2.

Production of Toner 7

Toner particles 7 are produced in manner similar to toner particles 3, except that dimethyl phthalate is used instead of rosin used in toner 3. 30 nm silica and 16 nm silica are externally added under the conditions similar to toner particles 3, thereby obtaining toner 7.

The shape factor of the obtained toner particles 7, the linear thermal expansion coefficient of toner 7, and the silica content are shown in Table 2.

Production of Toner 8

Toner particles 8 are produced in a similar manner to toner particles 4, except that dimethyl phthalate is used instead of rosin used in toner 4. 30 nm silica and 16 inn silica are externally added under the conditions similar to toner particles 4, thereby obtaining toner 8.

The shape factor of the obtained toner particles 8, the linear thermal expansion coefficient of toner 8, and the silica content are shown in Table 2.

Production of Toner 9

Toner particles 9 are produced in a manner similar to toner particles 1, except that 16 nm silica (R972 (trade name) made by NIPPON AEROSIL CO., LTD.) is used instead of rosin used in toner 1. 30 nm silica and 16 m silica are externally added under the conditions similar to toner particles 1, thereby obtaining toner 9.

The shape factor of the obtained toner particles 9, the linear thermal expansion coefficient of toner 9, and the silica content are shown in Table 2.

Production of Toner 10

Toner particles 10 are produced in a manner similar to toner particles 2, except that 16 nm silica (R972 (trade name) made by NIPPON AEROSIL CO., LTD.) is used instead of rosin used in toner 2. 30 nm silica and 16 nm silica are externally added under the conditions similar to toner particles 2, thereby obtaining toner 10.

The shape factor of the obtained toner particles 10, the linear thermal expansion coefficient of toner 10, and the silica content are shown in Table 2.

Production of Toner 11

Toner particles 11 are produced in a manner similar to toner particles 3, except that 16 nm silica (R972 (trade name) made by NIPPON AEROSIL CO., LTD.) is used instead of rosin used in toner 3. 30 nm silica and 16 nm silica are externally added under the conditions similar to toner particle 3, thereby obtaining toner 11.

The shape factor of the obtained toner particles 11, the linear thermal expansion coefficient of toner 11, and the silica content are shown in Table 2.

Production of Toner 12

Toner particles 12 are produced in a manner similar to toner particles 4, except that 16 nm silica (R972 (trade name) made by NIPPON AEROSIL CO., LTD.) is used instead of rosin used in toner 4. 30 nm silica and 16 nm silica are externally added under the conditions similar to toner particles 4, thereby obtaining toner 12.

The shape factor of the obtained toner particles 12, the linear thermal expansion coefficient of toner 12, and the silica content are shown in Table 2.

Production of Toner 13

Toner particles 13 are produced in a manner similar to toner particles 1, except that silicone resin (CF4101 (trade name) made by Dow Corning Toray Silicone Co., Ltd.) is used instead of rosin used in toner 1. 30 nm silica and 16 nm silica are externally added under the conditions similar to toner particles 1, thereby obtaining toner 13.

The shape factor of the obtained toner particles 13, the linear thermal expansion coefficient of toner 13, and the silica content are shown in Table 2.

Production of Toner 14

Toner particles 14 are produced in a manner similar to toner particles 2, except that silicone resin (CF4101 (trade name) made by Dow Corning Toray Silicone Co., Ltd.) is used instead of rosin used in toner 2. 30 nm silica and 16 nm silica are externally added under the conditions similar to toner particles 2, thereby obtaining toner 14.

The shape factor of the obtained toner particles 14, the linear thermal expansion coefficient of toner 14, and the silica content are shown in Table 2.

Production of Toner 15

Toner particles 15 are produced in a manner similar to toner particles 3, except that silicone resin (CF4101 (trade name) made by Dow Corning Toray Silicone Co., Ltd.) is used instead of rosin used in toner 3. 30 nm silica and 16 nm silica are externally added under the conditions similar to toner particles 3, thereby obtaining toner 15.

The shape factor of the obtained toner particles 15, the linear thermal expansion coefficient of toner 15, and the silica content are shown in Table 2.

Production of Toner 16

Toner particles 16 are produced in a manner similar to toner particles 4, except that silicone resin (CF4101 (trade name) made by Dow Corning Toray Silicone Co., Ltd.) is used instead of rosin used in toner 4. 30 nm silica and 16 nm silica are externally added under the conditions similar to toner particles 4, thereby obtaining toner 16.

The shape factor of the obtained toner particles 16, the linear thermal expansion coefficient of toner 16, and the silica content are shown in Table 2.

Production of Toner 17

Toner particles 17 are produced in a manner similar to toner particles 2, except that C.I. Pigment Blue 15:3 (phthalocyanine pigment, CYANINE BLUE 4937 (trade name) (Cyan) made by Dainichiseika Color & Chemicals Mfg. Co., Ltd.) is used instead of carbon black used in toner 2. 30 nm Silica and 16 nm silica are externally added under the conditions similar to toner particle 2, thereby obtaining toner 17.

The shape factor of the obtained toner particles 17, the linear thermal expansion coefficient of toner 17, and the silica content are shown in Table 2.

Production of Toner 18

Toner particles 18 are produced in a manner similar to toner particles 2, except that C.I. Pigment Red 122 (quinacridone pigment, CHROMOFINE MAGENTA 6887 (trade name) (Magenta) made by Dainichiseika Color & Chemicals Mfg. Co., Ltd.) is used instead of carbon black used in toner 2. 30 nm silica and 16 nm silica are externally added under the conditions similar to toner particles 2, thereby obtaining toner 18.

The shape factor of the obtained toner particles 18, the linear thermal expansion coefficient of toner 18, and the silica content are shown in Table 2.

Production of Toner 19

Toner particles 19 are produced in a manner similar to toner particles 2, except that C.I. Pigment Yellow 193 (anthraquinone pigment, CHROMOFINE YELLOW AF-1300 (trade name) (Yellow) made by Dainichiseika Color & Chemicals Mfg. Co., Ltd.) is used instead of carbon black used in toner 2. 30 nm silica and 16 nm silica are externally added under the conditions similar to toner particles 2, thereby obtaining toner 19.

The shape factor of the obtained toner particles 19, the linear thermal expansion coefficient of toner 19, and the silica content are shown in Table 2.

Production of Toner 20

Toner particles 20 are produced in a manner similar to toner particles 2, except that binder resin 5 is used instead of binder resin 1 used in toner 2. 30 nm silica and 16 nm silica are externally added under the conditions similar to toner particles 2, thereby obtaining toner 20.

The shape factor of the obtained toner particles 20, the linear thermal expansion coefficient of toner 20, and the silica content are shown in Table 2.

Production of Toner 21

Toner particles 21 are produced in a manner similar to toner particles 2, except that binder resin 4 is used instead of binder resin 1 used in toner 2. 30 nm silica and 16 nm silica are externally added under the conditions similar to toner particles 2, thereby obtaining toner 21.

The shape factor of the obtained toner particles 21, the linear thermal expansion coefficient of toner 21, and the silica content are shown in Table 3.

Production of Toner 22

Toner particles 22 are produced in a manner similar to toner particles 2, except that binder resin 3 is used instead of binder resin 1 used in toner 2. 30 nm silica and 16 nm silica are externally added under the conditions similar to toner particles 2, thereby obtaining toner 22.

The shape factor of the obtained toner particles 22, the linear thermal expansion coefficient of toner 22, and the silica content are shown in Table 3.

Production of Toner 23

Toner particles 23 are produced in a manner similar to toner particles 2, except that binder resin 2 is used instead of binder resin 1 used in toner 2. 30 nm silica and 16 nm silica are externally added under the conditions similar to toner particles 2, thereby obtaining toner 23.

The shape factor of the obtained toner particles 23, the linear thermal expansion coefficient of toner 23, and the silica content are shown in Table 3.

Production of Toner 24

Toner particles 24 are produced in a manner similar to toner particles 2, except that binder resin 6 is used instead of binder resin 1 used in toner 2. 30 nm silica and 16 nm silica are externally added under the conditions similar to toner particles 2, thereby obtaining toner 24.

The shape factor of the obtained toner particles 24, the linear thermal expansion coefficient of toner 24, and the silica content are shown in Table 3.

Production of Toner 25

Toner particles 25 are produced in a manner similar to toner particles 2, except that binder resin 7 is used instead of binder resin 1 used in toner 2. 30 nm silica and 16 nm silica are externally added under the conditions similar to toner particles 2, thereby obtaining toner 25.

The shape factor of the obtained toner particles 25, the linear thermal expansion coefficient of toner 25, and the silica content are shown in Table 3.

Production of Toner 26

Toner particles 26 are produced in a manner similar to toner particles 23, except that rosin used in toner 23 is not added. 30 nm silica and 16 nm silica are externally added under the conditions similar to toner particles 23, thereby obtaining toner 26.

The shape factor of the obtained toner particles 26, the linear thermal expansion coefficient of toner 26, and the silica content are shown in Table 3.

Production of Toner 27

Toner particles 27 are produced in a manner similar to toner particles 22, except that rosin used in toner 22 is not added. 30 nm silica and 16 nm silica are externally added under the conditions similar to toner particles 22, thereby obtaining toner 27.

The shape factor of the obtained toner particles 27, the linear thermal expansion coefficient of toner 27, and the silica content are shown in Table 3.

Production of Toner 28

Toner particles 28 are produced in a manner similar to toner particles 21, except that rosin used in toner 21 is not added. 30 nm silica and 16 nm silica are externally added under the conditions similar to toner particles 21, thereby obtaining toner 28.

The shape factor of the obtained toner particles 28, the linear thermal expansion coefficient of toner 28, and the silica content are shown in Table 3.

Production of Toner 29

Toner particles 29 are produced in a manner similar to toner particles 20, except that rosin used in toner 20 is not added. 30 nm silica and 16 nm silica are externally added under the conditions similar to toner particles 20, thereby obtaining toner 29.

The shape factor of the obtained toner particles 29, the linear thermal expansion coefficient of toner 29, and the silica content are shown in Table 3.

Production of Toner 30

Toner particles 30 are produced in a manner similar to toner particles 2, except that rosin used in toner 2 is not added. 30 nm silica and 16 nm silica are externally added under the conditions similar to toner particles 2, thereby obtaining toner 30.

The shape factor of the obtained toner particles 30, the linear thermal expansion coefficient of toner 30, and the silica content are shown in Table 3.

Production of Toner 31

Toner particles 31 are produced in a manner similar to toner particles 24, except that rosin used in toner 24 is not added. 30 nm silica and 16 nm silica are externally added under the conditions similar to toner particles 24, thereby obtaining toner 31.

The shape factor of the obtained toner particles 31, the linear thermal expansion coefficient of toner 31, and the silica content are shown in Table 3.

Production of Toner 32

Toner particles 32 are produced in a manner similar to toner particles 25, except that rosin used in toner 25 is not added. 30 nm silica and 16 nm silica are externally added under the conditions similar to toner particles 25, thereby obtaining toner 32.

The shape factor of the obtained toner particles 32, the linear thermal expansion coefficient of toner 32, and the silica content are shown in Table 3.

Production of Toners 33 to 39

Toner particles 33 to 39 are produced in a manner similar to toner particles 26 to 32 respectively, except that rosin is added instead of the azo compound used in toners 26 to 32 respectively. 30 nm silica and 16 nm silica are externally added under the conditions similar to toner particles 26 to 32, thereby obtaining toners 33 to 39.

The shape factor of the obtained toner particles 33 to 39, the linear thermal expansion coefficient of toners 33 to 39, and the silica content are shown in Table 3.

Production of Toner 40

Toner particles 2 are heated at a hot wind temperature of 120° C. for 10 minutes using a hot-wind spheronization apparatus (SFS-3 (trade name) made by Nippon Pneumatic Mfg. Co., Ltd.), whereby toner particles 40 are produced. 30 nm silica and 16 nm silica are externally added under the conditions similar to toner particles 2, thereby obtaining toner 40.

The shape factor of the obtained toner particles 40, the linear thermal expansion coefficient of toner 40, and the silica content are shown in Table 3.

Production of Toner 41

Toner particle 41 are produced in a manner similar toner 40, except that the condition for heating toner particles 2 using a hot-wind spheronization apparatus is changed to a hot wind temperature of 120° C. and 5 minutes. 30 nm silica and 16 nm silica are externally added under the conditions similar to toner particles 2, thereby obtaining toner 41.

The shape factor of the obtained toner particles 41, the linear thermal expansion coefficient of toner 41, and the silica content are shown in Table 4.

Production of Toner 42

The materials of the same composition as toner particles 2 are subjected to kneading and the kneaded materials are then subjected to pulverization, followed by cooling to 0° C. in the atmosphere of liquid nitrogen. Thereafter, the thus obtained product is subjected to pulverizing and classifying similarly to toner particle 2, whereby toner particles 42 are produced. 30 nm silica and 16 nm silica are externally added under the conditions similar to toner particles 2, thereby obtaining toner 42.

The shape factor of the obtained toner particles 42, the linear thermal expansion coefficient of toner 42, and the silica content are shown in Table 4.

Production of Toner 43

The materials of the same composition as toner particles 2 are subjected to kneading and the kneaded materials are then subjected to pulverization, followed by cooling the to −10° C. in the atmosphere of liquid nitrogen. Thereafter, the thus obtained product is subjected to pulverization and classification similarly to toner particle 2, while 10 parts of dry ice is added to 100 parts of the pulverized products, whereby toner particles 43 are produced. 30 nm silica and 16 nm silica are externally added under the conditions similar to toner particles 2, thereby obtaining toner 43.

The shape factor of the obtained toner particles 43, the linear thermal expansion coefficient of toner 43, and the silica content are shown in Table 4.

Production of Toner 44

Toner particles 44 are produced in a manner similar to toner particles 2, except that an ester compound (glycerin monobehenate, RIKEMAL B-100 (trade name) made by Riken Vitamin Co., Ltd.) is used instead of paraffin wax used in toner 2. 30 nm silica and 16 nm silica are externally added under the conditions similar to toner particles 2, thereby obtaining toner 44.

The shape factor of the obtained toner particles 44, the linear thermal expansion coefficient of toner 44, and the silica content are shown in Table 4.

Production of Toners 45 to 52

Toners 45 to 52 are produced in a manner similar to toner 2, except that the amount of 30 nm silica added to toner particles 2 is changed to 0.7 parts by weight (toner 45), 0.8 parts by weight (toner 46), 1.1 parts by weight (toner 47). 1.2 parts by weight (toner 48), 1.9 parts by weight (toner 49), 2.1 parts by weight (toner 50), 2.9 parts by weight (toner 51), and 3.1 parts by weight (toner 52) respectively.

The shape factors of the obtained toner particles 45 to 52, the linear thermal expansion coefficients of toners 45 to 52, and the silica content are shown in Table 4.

Production of Toner 53

Toner particles 53 are produced in a manner similar to toner particles 2, except that SUNWAX 151P (trade name) (made by Sanyo Chemical Laboratory Co., Ltd.) which is a polyethylene wax (PE) is used instead of paraffin wax used in toner 2. 30 nm silica and 16 nm silica are externally added under the conditions similar to toner particles 2, thereby obtaining toner 53.

The shape factor of the obtained toner particle 53, the linear thermal expansion coefficient of toner 53, and the silica content are shown in Table 4.

Production of Toner 54

Toner particles 54 are produced in a manner similar to toner particles 2, except that MITSUI HI-WAX NP055 (trade name) (made by Mitsui Chemicals Inc.) which is polypropylene wax (PP) is used instead of paraffin wax used in toner 2. 30 nm silica and 16 nm silica are externally added under the same conditions as toner particle 2, thereby obtaining toner 54.

The shape factor of the obtained toner particles 54, the linear thermal expansion coefficient of toner 54, and the silica content are shown in Table 4.

Production of Toner 55

Toner 55 are produced in a manner similar to toner 29, except that 2 parts of 40 nm silica are added in producing toner particles 29.

The shape factor of the obtained toner particles 55, the linear thermal expansion coefficient of toner 55, and the silica content are shown in Table 4.

Production of Toner 56

Toner 56 is produced in a manner similar to toner 33, except that 1 part of dimethyl phthalate is added in producing toner particles 33.

The shape factor of the obtained toner particles 56, the linear thermal expansion coefficient of toner 56, and the silica content are shown in Table 4.

Production of Carrier 1,000 parts of Mn—Mg ferrite (with an average particle diameter of 50 μm made by Powder Tech Co., Ltd.) is introduced into a kneader, a solution obtained by dissolving 150 parts of styrene-methylmethacrylate-acrylic acid copolymer (with a polymerization ratio of 39:60:1 (molar ratio), Tg of 100° C., and a weight-average molecular weight of 73,000, made by Soken Chemical & Engineering Co., Ltd.) in 700 parts of toluene is added thereto. The resulting mixture is blended at a normal temperature for 20 minutes, heated at 70° C. and dried under a reduced pressure, thereby obtaining a coated carrier. The obtained coated carrier is sieved by a 75 μm mesh to remove coarse powders, thereby obtaining carrier 1.

Production of Developer

Carrier 1 and toners 1 to 56 are introduced into a V blender at a weight ratio of 95:5 and are agitated for 20 minutes, thereby obtaining the electrostatic latent image developers.

Evaluation

Halftonedot Reproducibility

The halftone dot reproducibility is evaluated as follows. A modified APEOSPORT-C4300 (modified so as to work even when a developer is not introduced into a developing device and to print out when a fixing temperature is equal to or higher than a set temperature (170° C.) and then reaches the highest temperature (180° C.)) made by Fuji Xerox Co., Ltd. is used, the developers employing toners 1 to 54 respectively are used as examples, and the developers employing toners 55 and 56 respectively are used as comparative examples. The examples and the comparative examples are introduced to a developing machine and images are output using a test chart No. 3, 1986, of the Society of Electrophotography of Japan. Paper (J paper) made by Fuji Xerox Co., Ltd. is used as the paper.

The printing-out is stopped after continuously outputting 100 sheets, the test chart is output at a temperature which is the highest temperature and is equal to or higher than the set temperature, an image of the halftone dots in the end portion of the output image by 30 magnifications with an optical microscope is taken, and the average particle size of the halftone dots is calculated by analyzing the image. This is used as the initial halftone dot. Then, the machine is left in an atmosphere of humidity of 85% at 30° C. for 12 hours and then 10,000 sheets are continuously printed out. After printing out 10,000 sheets, the test chart is output at a temperature that is the highest temperature and is equal to or higher than the set temperature, and the same evaluation is carried out.

The average particle diameter of the halftone dots in the test chart is defined as X, the average particle diameter of the initial halftone dots is defined as Y, and the average particle diameter of halftone dots after printing out 10,000 sheets is defined as Z. The initial halftone dot is evaluated by Y/X, and the halftone dot after printing out 10,000 sheets is evaluated by Z/X, in accordance with the following evaluation criteria.

AA: equal to or higher than 1 and less than 1.03

A: equal to or higher than 1.03 and less than 1.07

B: equal to or higher than 1.07 and less than 1.1

C: equal to or higher than 1.1 and less than 1.15

D: equal to or higher than 1.15

AA to C are acceptable. Each of Y/X and Z/X is evaluated in accordance with the above criteria. However, those showing Y/X of D are not evaluated any longer. The results are shown in Tables 2 to 4.

Uneven Gloss of Halftone Dot

In the halftone dots after printing out 10,000 sheets, the uneven gloss is visually evaluated.

The evaluation criteria is as follows. The results are shown in Table 2 to 4.

A: Uneven gloss is not visible.

B: Uneven gloss is slightly visible but is within an acceptable range.

D: Uneven gloss is clearly visible.

TABLE 2

| | toner | binder resin | colorant | release agent | increasing viscosity in high-temperature area | decreasing viscosity in low-temperature area | SF1 | amount of silica | amount of external additive | linear thermal expansion coefficient [$10^{-15}$/° C.] | Y/X | Z/X | uneven gloss |
|---|---|---|---|---|---|---|---|---|---|---|---|---|---|
| Ex. 1 | 1 | 1 | CB | paraffin | 40 nm silica | rosin | 155 | 2.5 | 1.5 | 10.4 | AA | A | A |
| Ex. 2 | 2 | 1 | CB | paraffin | azo compound | rosin | 157 | 1.5 | 1.5 | 7.8 | AA | AA | A |
| Ex. 3 | 3 | 1 | CB | paraffin | polar particles | rosin | 156 | 1.5 | 1.5 | 10.3 | AA | A | A |
| Ex. 4 | 4 | 1 | CB | paraffin | gel-like material | rosin | 156 | 1.5 | 1.5 | 10.5 | AA | A | A |
| Ex. 5 | 5 | 1 | CB | paraffin | 40 nm silica | dimethyl phthalate | 151 | 2.5 | 1.5 | 10.8 | AA | A | A |
| Ex. 6 | 6 | 1 | CB | paraffin | azo compound | dimethyl phthalate | 155 | 1.5 | 1.5 | 8.2 | AA | AA | A |
| Ex. 7 | 7 | 1 | CB | paraffin | polar particles | dimethyl phthalate | 158 | 1.5 | 1.5 | 10.7 | AA | A | A |
| Ex. 8 | 8 | 1 | CB | paraffin | gel-like material | dimethyl phthalate | 155 | 1.5 | 1.5 | 11.6 | AA | A | A |
| Ex. 9 | 9 | 1 | CB | paraffin | 40 nm silica | 16 nm silica | 157 | 3.5 | 1.5 | 21 | A | B | A |
| Ex. 10 | 10 | 1 | CB | paraffin | azo compound | 16 nm silica | 156 | 2.5 | 1.5 | 8.5 | AA | AA | A |
| Ex. 11 | 11 | 1 | CB | paraffin | polar particles | 16 nm silica | 155 | 2.5 | 1.5 | 22 | A | B | A |
| Ex. 12 | 12 | 1 | CB | paraffin | gel-like material | 16 nm silica | 154 | 2.5 | 1.5 | 24 | A | B | A |
| Ex. 13 | 13 | 1 | CB | paraffin | 40 nm silica | silicone resin | 159 | 2.5 | 1.5 | 22.3 | A | B | A |
| Ex. 14 | 14 | 1 | CB | paraffin | azo compound | silicone resin | 157 | 1.5 | 1.5 | 8.8 | AA | AA | A |
| Ex. 15 | 15 | 1 | CB | paraffin | polar particles | silicone resin | 153 | 1.5 | 1.5 | 23.3 | A | B | A |
| Ex. 16 | 16 | 1 | CB | paraffin | gel-like material | silicone resin | 158 | 1.5 | 1.5 | 25.6 | A | B | A |
| Ex. 17 | 17 | 1 | Cyan | paraffin | azo compound | rosin | 159 | 1.5 | 1.5 | 7.8 | AA | AA | A |
| Ex. 18 | 18 | 1 | Magenta | paraffin | azo compound | rosin | 157 | 1.5 | 1.5 | 7.7 | AA | AA | A |
| Ex. 19 | 19 | 1 | Yellow | paraffin | azo compound | rosin | 152 | 1.5 | 1.5 | 7.8 | AA | AA | A |
| Ex. 20 | 20 | 5 | CB | paraffin | azo compound | rosin | 155 | 1.5 | 1.5 | 9.7 | AA | AA | A |

TABLE 3

| | toner | binder resin | colorant | release agent | increasing viscosity in high-temperature area | decreasing viscosity in low-temperature area | SF1 | amount of silica | amount of external additive | linear thermal expansion coefficient [$10^{-15}$/° C.] | Y/X | Z/X | uneven gloss |
|---|---|---|---|---|---|---|---|---|---|---|---|---|---|
| Ex. 21 | 21 | 4 | CB | paraffin | azo compound | rosin | 155 | 1.5 | 1.5 | 12 | AA | A | A |
| Ex. 22 | 22 | 3 | CB | paraffin | azo compound | rosin | 156 | 1.5 | 1.5 | 16 | AA | A | A |
| Ex. 23 | 23 | 2 | CB | paraffin | azo compound | rosin | 158 | 1.5 | 1.5 | 35 | A | B | A |
| Ex. 24 | 24 | 6 | CB | paraffin | azo compound | rosin | 156 | 1.5 | 1.5 | 7 | AA | AA | A |
| Ex. 25 | 25 | 7 | CB | paraffin | azo compound | rosin | 155 | 1.5 | 1.5 | 6.3 | AA | AA | B |
| Ex. 26 | 26 | 2 | CB | paraffin | azo compound | — | 156 | 1.5 | 1.5 | 52 | A | C | A |
| Ex. 27 | 27 | 3 | CB | paraffin | azo compound | — | 159 | 1.5 | 1.5 | 26 | A | B | A |
| Ex. 28 | 28 | 4 | CB | paraffin | azo compound | — | 158 | 1.5 | 1.5 | 16 | AA | A | A |
| Ex. 29 | 29 | 5 | CB | paraffin | azo compound | — | 157 | 1.5 | 1.5 | 12 | AA | A | A |
| Ex. 30 | 30 | 1 | CB | paraffin | azo compound | — | 156 | 1.5 | 1.5 | 9 | AA | AA | A |
| Ex. 31 | 31 | 6 | CB | paraffin | azo compound | — | 152 | 1.5 | 1.5 | 8 | AA | AA | A |

TABLE 3-continued

| | toner | binder resin | colorant | release agent | increasing viscosity in high-temperature area | decreasing viscosity in low-temperature area | SF1 | amount of silica | amount of external additive | linear thermal expansion coefficient [$10^{-15}$/° C.] | Y/X | Z/X | uneven gloss |
|---|---|---|---|---|---|---|---|---|---|---|---|---|---|
| Ex. 32 | 32 | 7 | CB | paraffin | azo compound | — | 155 | 1.5 | 1.5 | 7.2 | AA | AA | B |
| Ex. 33 | 33 | 2 | CB | paraffin | — | rosin | 155 | 1.5 | 1.5 | 35 | A | B | A |
| Ex. 34 | 34 | 3 | CB | paraffin | — | rosin | 159 | 1.5 | 1.5 | 30.2 | A | B | A |
| Ex. 35 | 35 | 4 | CB | paraffin | — | rosin | 158 | 1.5 | 1.5 | 22.2 | A | B | A |
| Ex. 36 | 36 | 5 | CB | paraffin | — | rosin | 157 | 1.5 | 1.5 | 19.4 | AA | A | A |
| Ex. 37 | 37 | 1 | CB | paraffin | — | rosin | 157 | 1.5 | 1.5 | 15.2 | AA | A | A |
| Ex. 38 | 38 | 6 | CB | paraffin | — | rosin | 153 | 1.5 | 1.5 | 12.6 | AA | A | A |
| Ex. 39 | 39 | 7 | CB | paraffin | — | rosin | 155 | 1.5 | 1.5 | 11.1 | AA | A | A |
| Ex. 40 | 40 | 1 | CB | paraffin | azo compound | rosin | 143 | 1.5 | 1.5 | 7.8 | AA | A | A |

TABLE 4

| | toner | binder resin | colorant | release agent | increasing viscosity in high-temperature area | decreasing viscosity in low-temperature area | SF1 | amount of silica | amount of external additive | linear thermal expansion coefficient [$10^{-15}$/° C.] | Y/X | Z/X | uneven gloss |
|---|---|---|---|---|---|---|---|---|---|---|---|---|---|
| Ex. 41 | 41 | 1 | CB | paraffin | azo compound | rosin | 146 | 1.5 | 1.5 | 7.8 | AA | AA | A |
| Ex. 42 | 42 | 1 | CB | paraffin | azo compound | rosin | 168 | 1.5 | 1.5 | 7.8 | AA | AA | A |
| Ex. 43 | 43 | 1 | CB | paraffin | azo compound | rosin | 172 | 1.5 | 1.5 | 7.8 | AA | A | A |
| Ex. 44 | 44 | 1 | CB | B-100 | azo compound | rosin | 157 | 1.5 | 1.5 | 58 | A | C | A |
| Ex. 45 | 45 | 1 | CB | paraffin | azo compound | rosin | 157 | 0.7 | 0.7 | 7.8 | A | B | A |
| Ex. 46 | 46 | 1 | CB | paraffin | azo compound | rosin | 157 | 0.8 | 0.8 | 7.8 | AA | A | A |
| Ex. 47 | 47 | 1 | CB | paraffin | azo compound | rosin | 157 | 1.1 | 1.1 | 7.8 | AA | A | A |
| Ex.. 48 | 48 | 1 | CB | paraffin | azo compound | rosin | 157 | 1.2 | 1.2 | 7.8 | AA | AA | A |
| Ex. 49 | 49 | 1 | CB | paraffin | azo compound | rosin | 157 | 1.9 | 1.9 | 7.8 | AA | AA | A |
| Ex. 50 | 50 | 1 | CB | paraffin | azo compound | rosin | 157 | 2.1 | 2.1 | 7.8 | AA | A | A |
| Ex. 51 | 51 | 1 | CB | paraffin | azo compound | rosin | 157 | 2.9 | 2.9 | 7.8 | AA | A | A |
| Ex. 52 | 52 | 1 | CB | paraffin | azo compound | rosin | 157 | 3.1 | 3.1 | 7.8 | A | B | A |
| Ex. 53 | 53 | 1 | CB | PE | azo compound | rosin | 155 | 1.5 | 1.5 | 7.8 | AA | A | A |
| Ex. 54 | 54 | 1 | CB | PP | azo compound | rosin | 155 | 1.5 | 1.5 | 7.8 | AA | A | A |
| Com. Ex. 1 | 55 | 5 | CB | paraffin | 40 nm silica, azo compound | — | 155 | 3.5 | 1.5 | 5.8 | AA | AA | D |
| Com. Ex. 2 | 56 | 2 | CB | paraffin | — | rosin, dimethyl phthalate | 156 | 1.5 | 1.5 | 120 | D | — | — |

The materials described in the "increasing viscosity in high-temperature area" in Tables 2 to 4 mean the "materials having an effect of increasing viscosity in a high-temperature area", and the materials described in the "decreasing viscosity in low-temperature area" means the "materials having an effect of decreasing viscosity in a low-temperature area".

The "SF1" represents the shape factor of the toner particles and the "amount of silica" represents the total silica in the total toner mass (the amount (parts by weight) of silica internally added to the toner particles and silica externally added to the toner particles). The "amount of external additive" represents the ratio (% by weight) of silica as the external additive (silica externally added to the toner particles) measured by the XPS, with respect to the total toner weight.

As can be seen from Tables 2 to 4, in comparison with toners 55 and 56 according to Comparative Examples 1 and 2 in which the linear thermal expansion coefficient of the toner is not in the range of from $6\times10^{-5}$/° C. to $1\times10^{-3}$/° C., in toners 1 to 54 according to the examples of the invention, the deterioration in halftone dot reproducibility of the fixed image is suppressed, and the uneven gloss of the halftone dot image is suppressed.

When the material having an effect of increasing viscosity in a high-temperature area and the material having an effect of decreasing viscosity in a low-temperature area are added to the toner, the deterioration in halftone dot reproducibility of the fixed image is further suppressed. Particularly, toners 2, 6, 10, 14, 17 to 20, 24, 30, 31, 41, 42, 48, and 49, in which the azo compound is added as the material having an effect of increasing viscosity in a high-temperature area, are excellent in both of suppression of the deterioration in halftone dot reproducibility and suppression of the uneven gloss of the halftone dot image.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments are chosen and described in order to best explain the principles of the invention and its practical applications, thereby enabling others skilled in the art to understand the invention for various embodiments and with the various modifications as are suited to the particular use contemplated.

What is claimed is:

1. A toner for electrostatic latent image development comprising toner particles, the toner particles including:

a silicone resin, a binder resin comprising a polyester resin containing an alcohol component and a polyhydric carboxylic acid component, the polyhydric carboxylic acid component comprising a component derived from terephthalic acid and fumaric acid, and the alcohol component comprising a component derived from ethylene glycol and a component derived from a member selected from the group consisting of an ethylene oxide adduct of bisphenol A, a propylene oxide adduct of bisphenol A, and both thereof, a release agent, a colorant, and a C.I. Pigment Yellow 180, of which amount is smaller than an amount of the colorant, wherein, the toner has a linear thermal expansion coefficient in accordance with JIS K 7197-1991 of from $6\times10^{-5}$/° C. to $1\times10^{-3}$/° C.; wherein the number-average particle size distribution index (GSDp) of the toner is in the range of from 1.20 to 1.27.

2. The toner for electrostatic latent image development according to claim 1, wherein the toner particles have a shape factor (SF1) of from about 145 to about 170.

3. The toner for electrostatic latent image development according to claim 1, wherein the release agent includes polypropylene, polyethylene, or paraffin.

4. The toner for electrostatic latent image development according to claim 1, wherein the toner particles further include a material having an effect of increasing viscosity in a high-temperature area in a content from about 0.1% by weight to about 10% by weight with respect to a total weight of the toner.

5. The toner for electrostatic latent image development according to claim 1, wherein the toner particles further include a material having an effect of decreasing viscosity in a low-temperature area.

6. The toner for electrostatic latent image development according to claim 5, wherein a content of the material having an effect of decreasing viscosity in a low-temperature area is from about 0.1% by weight to about 10% by weight with respect to a total weight of the toner.

7. The toner for electrostatic latent image development according to claim 5, wherein the material having an effect of decreasing viscosity in a low-temperature area is rosin.

8. The toner for electrostatic latent image development according to claim 1, wherein the toner further comprises, as an external additive, silica having a volume average particle diameter of 20 nm to 50 nm, and the silica is present in an amount of from about 0.8% by weight to about 3.0% by weight with respect to a total weight of the toner.

9. The toner for electrostatic latent image development according to claim 1, wherein the binder resin has a glass transition temperature of from about 35° C. to about 50° C.

10. The toner for electrostatic latent image development according to claim 1, wherein the toner has a volume average particle size distribution index (GSDv) of about 1.30 or less.

11. The toner for electrostatic latent image development according to claim 1, wherein the toner particles are obtained by kneading a toner forming material including the binder resin and the release agent to obtain a kneaded product, and by pulverizing the kneaded product.

12. An electrostatic latent image developer comprising the toner for electrostatic latent image development according to claim 1.

13. A toner cartridge which stores the toner for electrostatic latent image development according to claim 1 and is attachable to and detachable from an image forming apparatus.

14. A process cartridge which stores the electrostatic latent image developer according to claim 12, comprises a developing unit that develops a latent image formed on a latent image holding member with the electrostatic latent image developer to form a toner image, and is attachable to and detachable from to an image forming apparatus.

15. An image forming apparatus comprising:

a latent image holding member;

a charging unit that charges the surface of the latent image holding member;

an electrostatic latent image forming unit that forms an electrostatic latent image on the surface of the electrostatic latent image holding member;

a developing unit that develops the electrostatic latent image with the electrostatic latent image developer of claim 12 to form a toner image;

a transfer unit that transfers the toner image to a recording medium; and a fixing unit that fixes the toner image to the recording medium.

16. The toner for electrostatic latent image development according to claim 8, wherein all the silica in the external additive has the volume average particle diameter of 20 nm to 50 nm.

* * * * *